US008992261B2

(12) United States Patent
Mattson

(10) Patent No.: US 8,992,261 B2
(45) Date of Patent: Mar. 31, 2015

(54) SINGLE-PIECE PLUG NOSE WITH MULTIPLE CONTACT SETS

(75) Inventor: Loren J. Mattson, Richfield, MN (US)

(73) Assignee: ADC Telecommunications, Inc., Berwyn, PA (US)

( * ) Notice: Subject to any disclaimer, the term of this patent is extended or adjusted under 35 U.S.C. 154(b) by 552 days.

(21) Appl. No.: 13/273,691

(22) Filed: Oct. 14, 2011

(65) Prior Publication Data

US 2012/0146660 A1 Jun. 14, 2012

Related U.S. Application Data

(60) Provisional application No. 61/405,865, filed on Oct. 22, 2010.

(51) Int. Cl.

| | |
|---|---|
| ***H01R 24/00*** | (2011.01) |
| ***H01R 13/68*** | (2011.01) |
| ***H01R 13/66*** | (2006.01) |
| ***H01R 13/52*** | (2006.01) |
| *H01R 13/50* | (2006.01) |
| *H01R 24/64* | (2011.01) |

(52) U.S. Cl.

CPC ..... *H01R 13/6658* (2013.01); *H01R 13/5213* (2013.01); *H01R 13/501* (2013.01); *H01R 24/64* (2013.01); *H01R 2201/04* (2013.01); *Y10S 439/955* (2013.01)

USPC ..... 439/620.23; 439/955

(58) Field of Classification Search

USPC ..... 439/676, 620.23, 955

See application file for complete search history.

(56) References Cited

U.S. PATENT DOCUMENTS

| | | | | |
|---|---|---|---|---|
| 3,243,761 | A | 3/1966 | Piorunneck | |
| 3,961,834 | A * | 6/1976 | Venaleck et al. | 439/76.1 |
| 4,042,289 | A * | 8/1977 | Heinonen et al. | 439/629 |
| 4,127,317 | A | 11/1978 | Tyree | |
| 4,412,715 | A * | 11/1983 | Bogese, II | 439/425 |
| 4,679,879 | A * | 7/1987 | Triner et al. | 439/425 |
| 4,684,245 | A | 8/1987 | Goldring | |
| 4,953,194 | A | 8/1990 | Hansen et al. | |
| 4,968,929 | A | 11/1990 | Hauck et al. | |

(Continued)

FOREIGN PATENT DOCUMENTS

| | | |
|---|---|---|
| AU | 2006233238 A1 | 5/2007 |
| CA | 2499803 | 4/2004 |

(Continued)

OTHER PUBLICATIONS

*Avaya's Enhanced SYSTIMAX® iPatch System Enables IT Managers to Optimise Network Efficiency and Cut Downtime*, Press Release, May 9, 2003, obtained from http://www.avaya.com/usa/about-avaya/newsroom/news-releases/2003/pr-030509 on Jan. 7, 2009.

(Continued)

*Primary Examiner* — Neil Abrams

(74) *Attorney, Agent, or Firm* — Merchant & Gould P.C.

(57) ABSTRACT

A connector arrangement includes a single-piece plug nose body defining a cavity in which a storage device is held. The storage device provides physical layer information (PLI) functionality as well as physical layer management (PLM) functionality to the connector arrangement. A pivotable cover for the cavity is attached to the plug nose body by a living hinge. Example storage devices include an EEPROM on a printed circuit board. The storage device is electrically isolated from primary contacts of the connector arrangement.

13 Claims, 39 Drawing Sheets

(56) References Cited

U.S. PATENT DOCUMENTS 4,978,310 A 12/1990 Shichida
5,052,940 A 10/1991 Bengal
5,107,532 A 4/1992 Hansen et al.
5,161,988 A 11/1992 Krupka
5,166,970 A 11/1992 Ward
5,222,164 A 6/1993 Bass, Sr. et al.
5,265,187 A 11/1993 Morin et al.
5,305,405 A 4/1994 Emmons et al.
5,353,367 A 10/1994 Czosnowski et al.
5,393,249 A 2/1995 Morgenstern et al.
5,394,503 A 2/1995 Dietz, Jr. et al.
5,413,494 A 5/1995 Dewey et al.
5,415,570 A 5/1995 Sarkissian
5,418,334 A 5/1995 Williams
5,419,717 A 5/1995 Abendschein et al.
5,448,675 A 9/1995 Leone et al.
5,467,062 A 11/1995 Burroughs et al.
5,470,251 A 11/1995 Sano
5,473,715 A 12/1995 Schofield et al.
5,483,467 A 1/1996 Krupka et al.
5,660,567 A 8/1997 Nierlich et al.
5,674,085 A 10/1997 Davis et al.
5,685,741 A 11/1997 Dewey et al.
5,712,942 A 1/1998 Jennings et al.
5,764,043 A 6/1998 Czosnowski et al.
5,800,192 A 9/1998 David et al.
5,821,510 A 10/1998 Cohen et al.
5,854,824 A 12/1998 Bengal et al.
5,871,368 A 2/1999 Erdner et al.
5,905,637 A * 5/1999 Su ..... 361/752
5,910,776 A 6/1999 Black
6,002,331 A 12/1999 Laor
6,079,996 A 6/2000 Arnett
6,089,908 A 7/2000 Huang
6,095,837 A 8/2000 David et al.
6,095,851 A 8/2000 Laity et al.
6,116,961 A 9/2000 Henneberger et al.
6,141,212 A * 10/2000 Fletcher et al. ..... 361/679.45
6,222,908 B1 4/2001 Bartolutti et al.
6,222,975 B1 4/2001 Gilbert et al.
6,227,911 B1 5/2001 Boutros et al.
6,234,830 B1 5/2001 Ensz et al.
6,238,235 B1 5/2001 Shavit et al.
6,276,943 B1 * 8/2001 Boutros et al. ..... 439/76.1
6,280,231 B1 8/2001 Nicholls
6,285,293 B1 9/2001 German et al.
6,300,877 B1 10/2001 Schannach et al.
6,330,148 B1 12/2001 Won et al.
6,330,307 B1 12/2001 Bloch et al.
6,350,148 B1 2/2002 Bartolutti et al.
6,354,865 B1 * 3/2002 Bogese ..... 439/418
6,364,694 B1 4/2002 Lien
6,421,322 B1 7/2002 Koziy et al.
6,422,895 B1 7/2002 Lien
6,424,710 B1 7/2002 Bartolutti et al.
6,456,768 B1 9/2002 Boncek et al.
D466,479 S 12/2002 Pein et al.
6,499,861 B1 12/2002 German et al.
6,511,231 B2 1/2003 Lampert et al.
6,522,737 B1 2/2003 Bartolutti et al.
6,554,484 B2 4/2003 Lampert
6,574,586 B1 6/2003 David et al.
6,612,856 B1 9/2003 McCormack
6,626,697 B1 9/2003 Martin et al.
6,636,152 B2 10/2003 Schannach et al.
6,684,179 B1 1/2004 David
6,725,177 B2 4/2004 David et al.
6,743,044 B2 6/2004 Musolf et al.
6,793,408 B2 9/2004 Levy et al.
6,802,735 B2 10/2004 Pepe et al.
6,808,116 B1 10/2004 Eslambolchi et al.
6,811,446 B1 11/2004 Chang
6,814,624 B2 11/2004 Clark et al.
6,847,856 B1 1/2005 Bohannon
6,850,685 B2 2/2005 Tinucci et al.
6,890,197 B2 5/2005 Liebenow
6,898,368 B2 5/2005 Colombo et al.
6,905,363 B2 6/2005 Musolf et al.
6,932,517 B2 8/2005 Swayze et al.
D510,068 S 9/2005 Haggay et al.
6,939,168 B2 9/2005 Oleynick et al.
6,961,675 B2 11/2005 David
6,968,994 B1 11/2005 Ashwood Smith
6,971,895 B2 12/2005 Sago et al.
6,976,867 B2 12/2005 Navarro et al.
7,077,710 B2 7/2006 Haggay et al.
7,081,808 B2 7/2006 Colombo et al.
7,112,090 B2 9/2006 Caveney et al.
7,123,810 B2 10/2006 Parrish
7,153,142 B2 12/2006 Shifris et al.
7,165,728 B2 1/2007 Durrant et al.
7,193,422 B2 3/2007 Velleca et al.
7,207,819 B2 4/2007 Chen
7,210,858 B2 5/2007 Sago et al
7,226,217 B1 6/2007 Benton et al.
7,234,944 B2 6/2007 Nordin et al.
7,241,157 B2 7/2007 Zhuang et al.
7,297,018 B2 11/2007 Caveney et al.
7,312,715 B2 12/2007 Shalts et al.
D559,186 S 1/2008 Kelmer
7,314,392 B2 * 1/2008 Pharn et al. ..... 439/676
7,315,224 B2 1/2008 Gurovich et al.
7,352,285 B2 4/2008 Sakama et al.
7,352,289 B1 4/2008 Harris
7,370,106 B2 5/2008 Caveney
7,374,101 B2 5/2008 Kaneko
7,384,300 B1 6/2008 Salgado et al.
7,396,245 B2 7/2008 Huang et al.
7,407,417 B2 * 8/2008 Pepe et al. ..... 439/676
7,479,032 B2 1/2009 Hoath et al.
7,481,681 B2 1/2009 Caveney et al.
7,497,709 B1 3/2009 Zhang
7,519,000 B2 4/2009 Caveney et al.
7,530,823 B1 5/2009 Thornton et al.
7,534,137 B2 5/2009 Caveney et al.
7,552,872 B2 6/2009 Tokita et al.
7,559,805 B1 7/2009 Yi et al.
7,563,116 B2 7/2009 Wang
7,570,861 B2 8/2009 Smrha et al.
7,575,454 B1 8/2009 Aoki et al.
7,588,470 B2 9/2009 Li et al.
7,591,667 B2 9/2009 Gatnau Navarro et al.
7,604,515 B2 * 10/2009 Siemon et al. ..... 439/676
7,605,707 B2 10/2009 German et al.
7,607,926 B2 10/2009 Wang
7,635,280 B1 12/2009 Crumlin et al.
7,648,377 B2 1/2010 Naito et al.
7,674,126 B2 * 3/2010 Below et al. ..... 439/489
7,682,174 B2 3/2010 Chen
7,722,370 B2 5/2010 Chin
7,727,026 B2 6/2010 Qin et al.
7,785,154 B2 8/2010 Peng
7,798,832 B2 9/2010 Qin et al.
7,803,013 B2 * 9/2010 Haggay et al. ..... 439/505
7,811,119 B2 10/2010 Caveney et al.
7,814,240 B2 10/2010 Salgado et al.
7,867,017 B1 1/2011 Chen
7,869,426 B2 1/2011 Hough et al.
7,872,738 B2 1/2011 Abbott
7,880,475 B2 2/2011 Crumlin et al.
8,157,582 B2 4/2012 Frey et al.
8,203,450 B2 * 6/2012 German et al. ..... 340/572.1
8,257,118 B2 * 9/2012 Bareel et al. ..... 439/676
8,272,892 B2 9/2012 McNeely et al.
8,282,425 B2 10/2012 Bopp et al.
8,287,316 B2 10/2012 Pepe et al.
8,340,093 B2 * 12/2012 Shifris et al. ..... 370/389
8,388,386 B2 * 3/2013 Petersen ..... 439/676
8,391,321 B2 * 3/2013 Diab ..... 370/522
8,449,318 B2 5/2013 Beller et al.
8,480,438 B2 * 7/2013 Mattson ..... 439/676
8,696,369 B2 * 4/2014 Mattson et al. ..... 439/131
8,715,012 B2 * 5/2014 Taylor ..... 439/676
8,795,003 B2 * 8/2014 Mattson ..... 439/676

(56) References Cited

U.S. PATENT DOCUMENTS

| | | | | |
|---|---|---|---|---|
| 2002/0008613 | A1 | 1/2002 | Nathan et al. | |
| 2004/0052498 | A1 | 3/2004 | Colombo et al. | |
| 2004/0240807 | A1 | 12/2004 | Frohlich et al. | |
| 2006/0148279 | A1 | 7/2006 | German et al. | |
| 2006/0160395 | A1 | 7/2006 | Macauley et al. | |
| 2007/0237470 | A1 | 10/2007 | Aronson et al. | |
| 2007/0238343 | A1 | 10/2007 | Velleca et al. | |
| 2007/0254529 | A1 | 11/2007 | Pepe et al. | |
| 2008/0090454 | A1 | 4/2008 | Hoath et al. | |
| 2008/0100467 | A1 | 5/2008 | Downie et al. | |
| 2009/0097846 | A1 | 4/2009 | Kozischek et al. | |
| 2009/0098763 | A1 | 4/2009 | Below et al. | |
| 2009/0148106 | A1 | 6/2009 | Moore et al. | |
| 2009/0166404 | A1 | 7/2009 | German et al. | |
| 2009/0215310 | A1 | 8/2009 | Hoath et al. | |
| 2009/0232455 | A1 | 9/2009 | Nhep | |
| 2010/0048064 | A1 | 2/2010 | Peng | |
| 2010/0057944 | A1 | 3/2010 | Eberhard | |
| 2010/0211664 | A1 | 8/2010 | Raza et al. | |
| 2010/0211665 | A1 | 8/2010 | Raza et al. | |
| 2010/0211697 | A1 | 8/2010 | Raza et al. | |
| 2010/0215049 | A1 | 8/2010 | Raza et al. | |
| 2011/0092100 | A1 | 4/2011 | Coffey et al. | |
| 2011/0115494 | A1 | 5/2011 | Taylor et al. | |
| 2012/0003877 | A1 | 1/2012 | Bareel et al. | |
| 2012/0021636 | A1 | 1/2012 | Debenedictis et al. | |
| 2013/0095694 | A1 * | 4/2013 | Shifris et al. | 439/491 |

FOREIGN PATENT DOCUMENTS

| | | | |
|---|---|---|---|
| DE | 41 14 921 | A1 | 11/1992 |
| DE | G 94 00 653.9 | U1 | 7/1994 |
| DE | 102 44 304 | B3 | 3/2004 |
| DE | 10 2004 033 940 | A1 | 2/2006 |
| GB | 2 236 398 | A | 4/1991 |
| WO | WO 00/60475 | | 10/2000 |
| WO | WO 00/65696 | | 11/2000 |
| WO | WO 02/47215 | A1 | 6/2002 |
| WO | WO 2010/001400 | A1 | 1/2010 |
| WO | WO 2010/081186 | A1 | 7/2010 |
| WO | WO 2010/121639 | A1 | 10/2010 |

OTHER PUBLICATIONS

*Avaya's Enhanced SYSTIMAX® iPatch System Enables IT Managers to Optimise Network Efficiency and Cut Downtime*, Press Release, May 20, 2003, obtained from http://www.avaya.com/usa/about-avaya/newsroom/news-releases/2003/pr-030520 on Jan. 7, 2009.

*Intelligent patching systems carving out a 'large' niche*, Cabling Installation & Maintenance, vol. 12, Issue 7, Jul. 2004 (5 pages).

*intelliMAC: The intelligent way to make Moves, Adds or Changes*! NORDX/CDT © 2003 (6 pages).

International Search Report and Written Opinion for PCT/US2012/052872 mailed Jan. 12, 2011.

International Search Report and Written Opinion for PCT/US2010/053228 mailed Mar. 28, 2011.

Partial International Search for PCT/US2010/053228 mailed Feb. 14, 2011.

iTRACS Physical Layer Manager FAQ, obtained on Jun. 11, 2008 from http://www.itracs.com/products/physical-layer-manager-faqs.html (6 pages).

Meredith, L., "Managers missing point of intelligent patching," *Daa Center News*, Jun. 21, 2005, obtained Dec. 2, 2008 from http://searchdatacenter.techtarget.com/news/article/0,289142,sid80_gcil099991,00.html.

Ohtsuki, F. et al., "Design of Optical Connectors with ID Modules," *Electronics and Communications in Japan*, Part 1, vol. 77, No. 2, pp. 94-105 (Feb. 1994).

*Systimax® iPatch System Wins Platinum Network of the Year Award*, Press Release, Jan. 30, 2003, obtained from http://www.avaya.com/usa/about-avaya/newsroom/news-releases/2003/pr-030130a on Jan. 7, 2009.

TrueNet; TFP Series Rack Mount Fiber Panels, Spec Sheet; May 2008; 8 pages.

Partial International Search Report mailed Jan. 19, 2012.

International Search Report and Written Opinion mailed Mar. 1, 2012.

* cited by examiner

SINGLE-PIECE PLUG NOSE WITH MULTIPLE CONTACT SETS

CROSS REFERENCE TO RELATED APPLICATION

This application claims the benefit of U.S. Provisional Application No. 61/405,865, filed Oct. 22, 2010, and titled "Single-Piece Plug Nose," the disclosure of which is hereby incorporated herein by reference.

BACKGROUND

In communications infrastructure installations, a variety of communications devices can be used for switching, cross-connecting, and interconnecting communications signal transmission paths in a communications network. Some such communications devices are installed in one or more equipment racks to permit organized, high-density installations to be achieved in limited space available for equipment.

Communications devices can be organized into communications networks, which typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross-connects the two together. In other words, a single logical communication link is often implemented using several segments of physical communication media.

Network management systems (NMS) are typically aware of logical communication links that exist in a communications network, but typically do not have information about the specific physical layer media (e.g., the communications devices, cables, couplers, etc.) that are used to implement the logical communication links. Indeed, NMS systems typically do not have the ability to display or otherwise provide information about how logical communication links are implemented at the physical layer level.

SUMMARY

The present disclosure relates to communications connector assemblies and connector arrangements that provide physical layer management capabilities. In accordance with certain aspects, the disclosure relates to fiber optic connector assemblies and connector arrangements.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
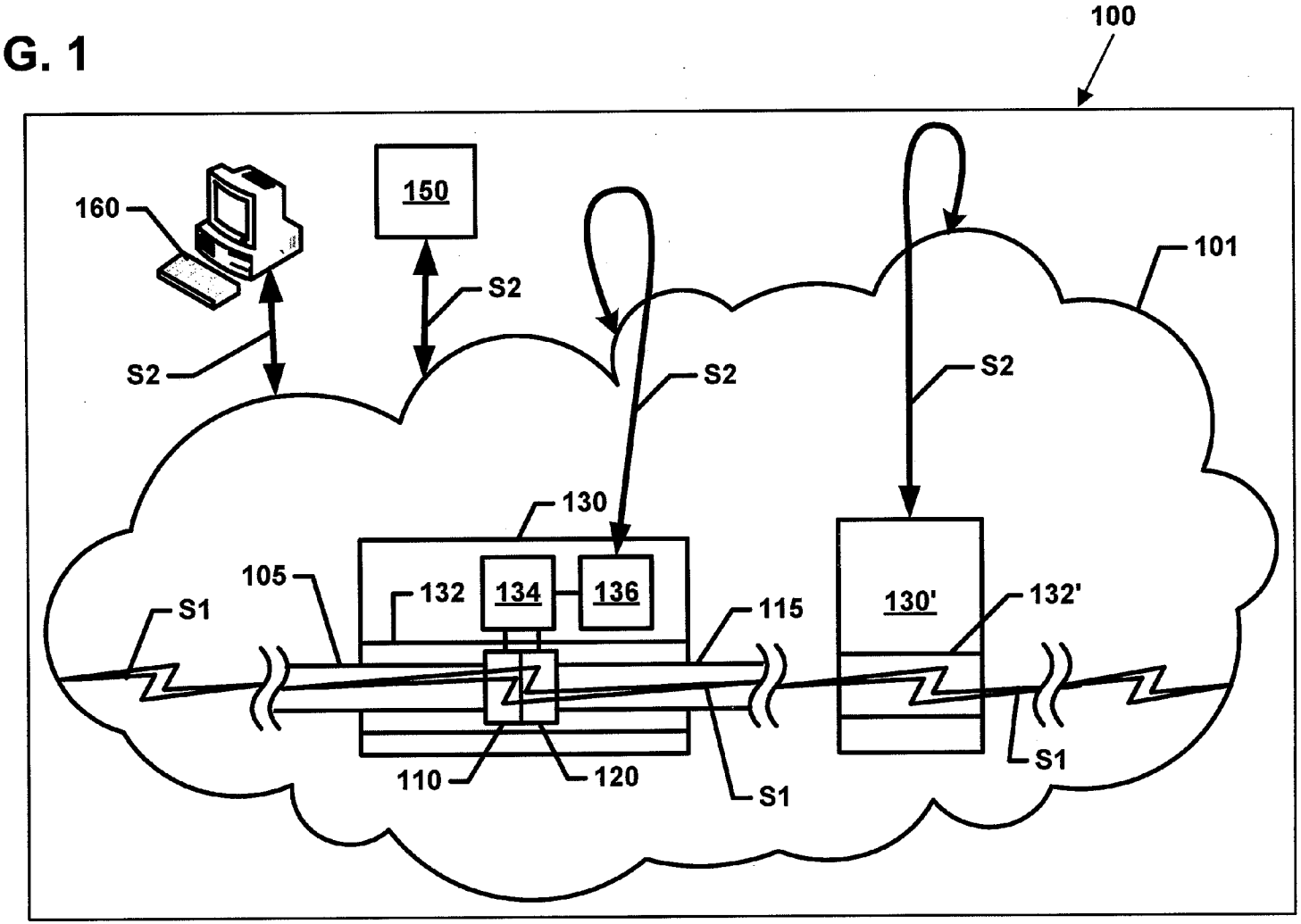
FIG. 1 is a block diagram of a portion of an example communications and data management system in accordance with aspects of the present disclosure.

FIG. 1 is a diagram of a portion of an example communications and data management system 100. The example system 100 shown in FIG. 1 includes a part of a communications network 101 along which communications signals S1 pass. In one example implementation, the network 101 can include an Internet Protocol network. In other implementations, however, the communications network 101 may include other types of networks.

The communications network 101 includes interconnected network components (e.g., connector assemblies, inter-networking devices, internet working devices, servers, outlets, and end user equipment (e.g., computers)). In one example implementation, communications signals S1 pass from a computer to a wall outlet to a port of communication panel, to a first port of an inter-networking device, out another port of the inter-networking device, to a port of the same or another communications panel, to a rack mounted server.

The portion of the communications network 101 shown in FIG. 1 includes first and second connector assemblies 130, 130' at which communications signals S1 pass from one portion of the communications network 101 to another portion of the communications network 101. Non-limiting examples of connector assemblies 130, 130' include, for example, rack-mounted connector assemblies (e.g., patch panels, distribution units, and media converters for fiber and copper physical communication media), wall-mounted connector assemblies (e.g., boxes, jacks, outlets, and media converters for fiber and copper physical communication media), and inter-networking devices (e.g., switches, routers, hubs, repeaters, gateways, and access points). In the example shown, the first connector assembly 130 defines at least one port 132 configured to communicatively couple at least a first media segment 105 to at least a second media segment 115 to enable the communication signals S1 to pass between the media segments 105, 115.

The at least one port 132 of the first connector assembly 130 may be directly connected to a port 132' of the second connector assembly 130'. As the term is used herein, the port 132 is directly connected to the port 132' when the communications signals S1 pass between the two ports 132, 132' without passing through an intermediate port. For example, routing a patchcord between port 132 and port 132' directly connects the ports 132, 132'.

The port 132 of the first connector assembly 130 also may be indirectly connected to the port 132' of the second connector assembly 130'. As the term is used herein, the port 132 is indirectly connected to the port 132' when the communications signals S1 pass through an intermediate port when traveling between the ports 132, 132'. For example, in one implementation, the communications signals S1 may be routed over one media segment from the port 132 at the first connector assembly 130 to a port of a third connector assembly at which the media segment is coupled to another media segment that is routed from the port of the third connector assembly to the port 132' of the second connector assembly 130'.

Non-limiting examples of media segments include optical fibers, which carry optical data signals, and electrical conductors (e.g., CAT-5, 6, and 7 twisted-pair cables), which carry electrical data signals. Media segments also can include electrical plugs, fiber optic connectors (e.g., SC, LC, FC, LX.5, or MPO connectors), adapters, media converters, and other physical components terminating to the fibers, conductors, or other such media segments. The techniques described here also can be used with other types of connectors including, for example, BNC connectors, F connectors, DSX jacks and plugs, bantam jacks and plugs.

In the example shown, each media segment 105, 115 is terminated at a plug or connector 110, 120, respectively, which is configured to communicatively connect the media segments 105, 115. For example, in one implementation, the port 132 of the connector assembly 130 can be configured to align ferrules of two fiber optic connectors 110, 120. In another implementation, the port 132 of the connector assembly 130 can be configured to electrically connect an electrical plug with an electrical socket (e.g., a jack). In yet another implementation, the port 132 can include a media converter configured to connect an optical fiber to an electrical conductor.

In accordance with some aspects, the connector assembly 130 does not actively manage (e.g., is passive with respect to) the communications signals S1 passing through port 132. For example, in some implementations, the connector assembly 130 does not modify the communications signal S1 carried over the media segments 105, 115. Further, in some implementations, the connector assembly 130 does not read, store, or analyze the communications signal S1 carried over the media segments 105, 115.

In accordance with aspects of the disclosure, the communications and data management system 100 also provides physical layer information (PLI) functionality as well as physical layer management (PLM) functionality. As the term is used herein, "PLI functionality" refers to the ability of a physical component or system to identify or otherwise associate physical layer information with some or all of the physical components used to implement the physical layer of the system. As the term is used herein, "PLM functionality" refers to the ability of a component or system to manipulate or to enable others to manipulate the physical components used to implement the physical layer of the system (e.g., to track what is connected to each component, to trace connections that are made using the components, or to provide visual indications to a user at a selected component).

As the term is used herein, "physical layer information" refers to information about the identity, attributes, and/or status of the physical components used to implement the physical layer of the communications system 101. In accordance with some aspects, physical layer information of the communications system 101 can include media information, device information, and location information.

As the term is used herein, "media information" refers to physical layer information pertaining to cables, plugs, connectors, and other such media segments. In accordance with some aspects, the media information is stored on or in the media segments, themselves. In accordance with other aspects, the media information can be stored at one or more data repositories for the communications system, either alternatively or in addition to the media, themselves. Non-limiting examples of media information include a part number, a serial number, a plug or other connector type, a conductor or fiber type, a cable or fiber length, cable polarity, a cable or fiber pass-through capacity, a date of manufacture, a manufacturing lot number, information about one or more visual attributes of physical communication media (e.g., information about the color or shape of the physical communication media or an image of the physical communication media), and an insertion count (i.e., a record of the number of times the media segment has been connected to another media segment or network component). Media information also can include testing or media quality or performance information. The testing or media quality or performance information, for example, can be the results of testing that is performed when a particular segment of media is manufactured.

As the term is used herein, "device information" refers to physical layer information pertaining to the communications panels, inter-networking devices, media converters, computers, servers, wall outlets, and other physical communications devices to which the media segments attach. In accordance with some aspects, the device information is stored on or in the devices, themselves. In accordance with other aspects, the device information can be stored at one or more data repositories for the communications system, either alternatively or in addition to the devices, themselves. Non-limiting examples of device information include a device identifier, a device type, port priority data (that associates a priority level with each port), and port updates (described in more detail herein).

As the term is used herein, "location information" refers to physical layer information pertaining to a physical layout of a building or buildings in which the network 101 is deployed. Location information also can include information indicating where each communications device, media segment, network component, or other component that is physically located within the building. In accordance with some aspects, the location information of each system component is stored on or in the respective component. In accordance with other aspects, the location information can be stored at one or more data repositories for the communications system, either alternatively or in addition to the system components, themselves.

In accordance with some aspects, one or more of the components of the communications network 101 is configured to store physical layer information pertaining to the component as will be disclosed in more detail herein. In FIG. 1, the connectors 110, 120, the media segments 105, 115, and/or the connector assemblies 130, 130' may store physical layer information. For example, in FIG. 1, each connector 110, 120 may store information pertaining to itself (e.g., type of connector, data of manufacture, etc.) and/or to the respective media segment 105, 115 (e.g., type of media, test results, etc.).

In another example implementation, the media segments 105, 115 or connectors 110, 120 may store media information that includes a count of the number of times that the media segment (or connector) has been inserted into port 132. In such an example, the count stored in or on the media segment is updated each time the segment (or plug or connector) is inserted into port 132. This insertion count value can be used, for example, for warranty purposes (e.g., to determine if the connector has been inserted more than the number of times specified in the warranty) or for security purposes (e.g., to detect unauthorized insertions of the physical communication media).

In accordance with certain aspects, one or more of the components of the communications network 101 also can read the physical layer information from one or more media segments retained thereat. In certain implementations, one or more network components includes a media reading interface that is configured to read physical layer information stored on or in the media segments or connectors attached thereto. For example, in one implementation, the connector assembly 130 includes a media reading interface 134 that can read media information stored on the media cables 105, 115 retained within the port 132. In another implementation, the media reading interface 134 can read media information stored on the connectors or plugs 110, 120 terminating the cables 105, 115, respectively.

In some implementations, some types of physical layer information can be obtained by the connector assembly 130 from a user at the connector assembly 130 via a user interface (e.g., a keypad, a scanner, a touch screen, buttons, etc.). The connector assembly 130 can provide the physical layer information obtained from the user to other devices or systems that are coupled to the network 101 (as described in more detail herein). In other implementations, some or all physical layer information can be obtained by the connector assembly 130 from other devices or systems that are coupled to the network 101. For example, physical layer information pertaining to media that is not configured to store such information can be entered manually into another device or system that is coupled to the network 101 (e.g., at the connector assembly 130, at the computer 160, or at the aggregation point 150).

In some implementations, some types of non-physical layer information (e.g., network information) can be obtained by one network component from other devices or systems that are coupled to the network 101. For example, the connector assembly 130 may pull non-physical layer information from one or more components of the network 101. In other implementations, the non-physical layer information can be obtained by the connector assembly 130 from a user at the connector assembly 130.

In accordance with some aspects of the disclosure, the physical layer information read by a network component may be processed or stored at the component. For example, in certain implementations, the first connector assembly 130 shown in FIG. 1 is configured to read physical layer information stored on the connectors 110, 120 and/or on the media segments 105, 115 using media reading interface 134. Accordingly, in FIG. 1, the first connector assembly 130 may store not only physical layer information about itself (e.g., the total number of available ports at that assembly 130, the number of ports currently in use, etc.), but also physical layer information about the connectors 110, 120 inserted at the ports and/or about the media segments 105, 115 attached to the connectors 110, 120.

In some implementations, the connector assembly 130 is configured to add, delete, and/or change the physical layer information stored in or on the segment of physical communication media 105, 115 (i.e., or the associated connectors 110, 120). For example, in some implementations, the media information stored in or on the segment of physical communication media 105, 115 can be updated to include the results of testing that is performed when a segment of physical media is installed or otherwise checked. In other implementations, such testing information is supplied to the aggregation point 150 for storage and/or processing. In some implementations, modification of the physical layer information does not affect the communications signals S1 passing through the connector assembly 130.

In other implementations, the physical layer information obtained by the media reading interface (e.g., interface 134 of FIG. 1) may be communicated (see PLI signals S2) over the network 101 for processing and/or storage. The components of the communications network 101 are connected to one or more aggregation devices 150 (described in greater detail herein) and/or to one or more computing systems 160. For example, in the implementation shown in FIG. 1, each connector assembly 130 includes a PLI port 136 that is separate from the "normal" ports 132 of the connector assembly 130. Physical layer information is communicated between the connector assembly 130 and the network 101 through the PLI port 136. In the example shown in FIG. 1, the connector assembly 130 is connected to a representative aggregation device 150, a representative computing system 160, and to other components of the network 101 (see looped arrow) via the PLI port 136.

The physical layer information is communicated over the network 101 just like any other data that is communicated over the network 101, while at the same time not affecting the communication signals S1 that pass through the connector assembly 130 on the normal ports 132. Indeed, in some implementations, the physical layer information may be communicated as one or more of the communication signals S1 that pass through the normal ports 132 of the connector assemblies 130, 130'. For example, in one implementation, a media segment may be routed between the PLI port 136 and one of the "normal" ports 132. In such an implementation, the physical layer information may be passed along the communications network 101 to other components of the communications network 101 (e.g., to the one or more aggregation points 150 and/or to the one or more computer systems 160). By using the network 101 to communicate physical layer information pertaining to it, an entirely separate network need not be provided and maintained in order to communicate such physical layer information.

In other implementations, however, the communications network 101 includes a data network along which the physical layer information described above is communicated. At least some of the media segments and other components of the data network may be separate from those of the communications network 101 to which such physical layer information pertains. For example, in some implementations, the first connector assembly 130 may include a plurality of fiber optic adapters defining ports at which connectorized optical fibers are optically coupled together to create an optical path for communications signals S1. The first connector assembly 130 also may include one or more electrical cable ports at which the physical layer information (see PLI signals S2) are passed to other parts of the data network. (e.g., to the one or more aggregation points 150 and/or to the one or more computer systems 160).

Figure 2:
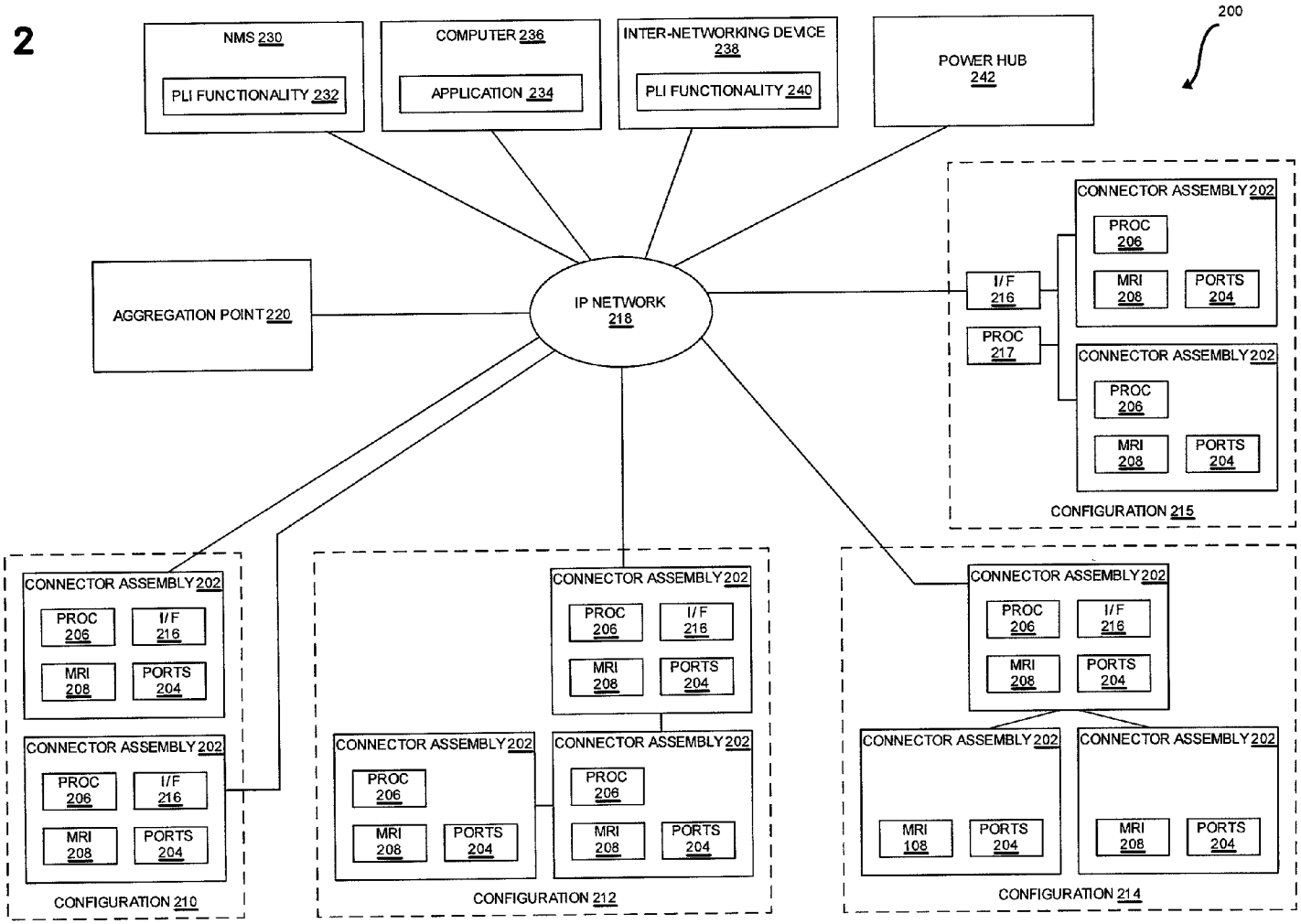
FIG. 2 is a block diagram of one embodiment of a communications management system that includes PLI functionality as well as PLM functionality in accordance with aspects of the present disclosure.

FIG. 2 is a block diagram of one example implementation of a communications management system 200 that includes PLI functionality as well as PLM functionality. The management system 200 comprises a plurality of connector assemblies 202. The system 200 includes one or more connector assemblies 202 connected to an IP network 218. The connector assemblies 202 shown in FIG. 2 illustrate various implementations of the connector assembly 130 of FIG. 1.

Each connector assembly 202 includes one or more ports 204, each of which is used to connect two or more segments of physical communication media to one another (e.g., to implement a portion of a logical communication link for communication signals S1 of FIG. 1). At least some of the connector assemblies 202 are designed for use with segments of physical communication media that have physical layer information stored in or on them. The physical layer information is stored in or on the segment of physical communication media in a manner that enables the stored information, when the segment is attached to a port 204, to be read by a programmable processor 206 associated with the connector assembly 202.

In the particular implementation shown in FIG. 2, each of the ports 204 of the connector assemblies 202 comprises a respective media reading interface 208 via which the respective programmable processor 206 is able to determine if a physical communication media segment is attached to that port 204 and, if one is, to read the physical layer information stored in or on the attached segment (if such media information is stored therein or thereon). The programmable processor 206 associated with each connector assembly 202 is communicatively coupled to each of the media reading interfaces 208 using a suitable bus or other interconnect (not shown).

In the particular implementation shown in FIG. 2, four example types of connector assembly configurations are shown. In the first connector assembly configuration 210 shown in FIG. 2, each connector assembly 202 includes its own respective programmable processor 206 and its own respective network interface 216 that is used to communicatively couple that connector assembly 202 to an Internet Protocol (IP) network 218.

In the second type of connector assembly configuration 212, a group of connector assemblies 202 are physically located near each other (e.g., in a bay or equipment closet). Each of the connector assemblies 202 in the group includes its own respective programmable processor 206. However, in the second connector assembly configuration 212, some of the connector assemblies 202 (referred to here as "interfaced connector assemblies") include their own respective network interfaces 216 while some of the connector assemblies 202 (referred to here as "non-interfaced connector assemblies") do not. The non-interfaced connector assemblies 202 are communicatively coupled to one or more of the interfaced connector assemblies 202 in the group via local connections. In this way, the non-interfaced connector assemblies 202 are communicatively coupled to the IP network 218 via the network interface 216 included in one or more of the interfaced connector assemblies 202 in the group. In the second type of connector assembly configuration 212, the total number of network interfaces 216 used to couple the connector assemblies 202 to the IP network 218 can be reduced. Moreover, in the particular implementation shown in FIG. 2, the non-interfaced connector assemblies 202 are connected to the interfaced connector assembly 202 using a daisy chain topology (though other topologies can be used in other implementations and embodiments).

In the third type of connector assembly configuration 214, a group of connector assemblies 202 are physically located near each other (e.g., within a bay or equipment closet). Some of the connector assemblies 202 in the group (also referred to here as "master" connector assemblies 202) include both their own programmable processors 206 and network interfaces 216, while some of the connector assemblies 202 (also referred to here as "slave" connector assemblies 202) do not include their own programmable processors 206 or network interfaces 216. Each of the slave connector assemblies 202 is communicatively coupled to one or more of the master connector assemblies 202 in the group via one or more local connections. The programmable processor 206 in each of the master connector assemblies 202 is able to carry out the PLM functions for both the master connector assembly 202 of which it is a part and any slave connector assemblies 202 to which the master connector assembly 202 is connected via the local connections. As a result, the cost associated with the slave connector assemblies 202 can be reduced. In the particular implementation shown in FIG. 2, the slave connector assemblies 202 are connected to a master connector assembly 202 in a star topology (though other topologies can be used in other implementations and embodiments).

Each programmable processor 206 is configured to execute software or firmware that causes the programmable processor 206 to carry out various functions described below. Each programmable processor 206 also includes suitable memory (not shown) that is coupled to the programmable processor 206 for storing program instructions and data. In general, the programmable processor 206 determines if a physical communication media segment is attached to a port 204 with which that processor 206 is associated and, if one is, to read the identifier and attribute information stored in or on the attached physical communication media segment (if the segment includes such information stored therein or thereon) using the associated media reading interface 208.

In the fourth type of connector assembly configuration 215, a group of connector assemblies 202 are housed within a common chassis or other enclosure. Each of the connector assemblies 202 in the configuration 215 includes their own programmable processors 206. In the context of this configuration 215, the programmable processors 206 in each of the connector assemblies are "slave" processors 206. Each of the slave programmable processor 206 is also communicatively coupled to a common "master" programmable processor 217 (e.g., over a backplane included in the chassis or enclosure). The master programmable processor 217 is coupled to a network interface 216 that is used to communicatively couple the master programmable processor 217 to the IP network 218.

In this configuration 215, each slave programmable processor 206 is configured to determine if physical communication media segments are attached to its port 204 and to read the physical layer information stored in or on the attached physical communication media segments (if the attached segments have such information stored therein or thereon) using the associated media reading interfaces 208. The physical layer information is communicated from the slave programmable processor 206 in each of the connector assemblies 202 in the chassis to the master processor 217. The master processor 217 is configured to handle the processing associated with communicating the physical layer information read from by the slave processors 206 to devices that are coupled to the IP network 218.

The system 200 includes functionality that enables the physical layer information that the connector assemblies 202 capture to be used by application-layer functionality outside of the traditional physical-layer management application domain. That is, the physical layer information is not retained in a PLM "island" used only for PLM purposes but is instead made available to other applications. In the particular implementation shown in FIG. 2, the management system 200 includes an aggregation point 220 that is communicatively coupled to the connector assemblies 202 via the IP network 218.

The aggregation point 220 includes functionality that obtains physical layer information from the connector assemblies 202 (and other devices) and stores the physical layer information in a data store. The aggregation point 220 can be used to receive physical layer information from various types of connector assemblies 202 that have functionality for automatically reading information stored in or on the segment of physical communication media. Also, the aggregation point 220 and aggregation functionality 224 can be used to receive physical layer information from other types of devices that have functionality for automatically reading information stored in or on the segment of physical communication media. Examples of such devices include end-user devices—such as computers, peripherals (e.g., printers, copiers, storage devices, and scanners), and IP telephones—that include functionality for automatically reading information stored in or on the segment of physical communication media.

The aggregation point 220 also can be used to obtain other types of physical layer information. For example, in this implementation, the aggregation point 220 also obtains information about physical communication media segments that is not otherwise automatically communicated to an aggregation point 220. This information can be provided to the aggregation point 220, for example, by manually entering such information into a file (e.g., a spreadsheet) and then uploading the file to the aggregation point 220 (e.g., using a web browser) in connection with the initial installation of each of the various items. Such information can also, for example, be directly entered using a user interface provided by the aggregation point 220 (e.g., using a web browser).

The aggregation point 220 also includes functionality that provides an interface for external devices or entities to access the physical layer information maintained by the aggregation point 220. This access can include retrieving information from the aggregation point 220 as well as supplying information to the aggregation point 220. In this implementation, the aggregation point 220 is implemented as "middleware" that is able to provide such external devices and entities with transparent and convenient access to the PLI maintained by the access point 220. Because the aggregation point 220 aggregates PLI from the relevant devices on the IP network 218 and provides external devices and entities with access to such PLI, the external devices and entities do not need to individually interact with all of the devices in the IP network 218 that provide PLI, nor do such devices need to have the capacity to respond to requests from such external devices and entities.

For example, as shown in FIG. 2, a network management system (NMS) 230 includes PLI functionality 232 that is configured to retrieve physical layer information from the aggregation point 220 and provide it to the other parts of the NMS 230 for use thereby. The NMS 230 uses the retrieved physical layer information to perform one or more network management functions. The NMS 230 communicates with the aggregation point 220 over the IP network 218.

As shown in FIG. 2, an application 234 executing on a computer 236 can also use the API implemented by the aggregation point 220 to access the PLI information maintained by the aggregation point 220 (e.g., to retrieve such information from the aggregation point 220 and/or to supply such information to the aggregation point 220). The computer 236 is coupled to the IP network 218 and accesses the aggregation point 220 over the IP network 218.

In the example shown in FIG. 2, one or more inter-networking devices 238 used to implement the IP network 218 include physical layer information (PLI) functionality 240. The PLI functionality 240 of the inter-networking device 238 is configured to retrieve physical layer information from the aggregation point 220 and use the retrieved physical layer information to perform one or more inter-networking functions. Examples of inter-networking functions include Layer 1, Layer 2, and Layer 3 (of the OSI model) inter-networking functions such as the routing, switching, repeating, bridging, and grooming of communication traffic that is received at the inter-networking device.

The aggregation point 220 can be implemented on a standalone network node (e.g., a standalone computer running appropriate software) or can be integrated along with other network functionality (e.g., integrated with an element management system or network management system or other network server or network element). Moreover, the functionality of the aggregation point 220 can be distribute across many nodes and devices in the network and/or implemented, for example, in a hierarchical manner (e.g., with many levels of aggregation points). The IP network 218 can include one or more local area networks and/or wide area networks (e.g., the Internet). As a result, the aggregation point 220, NMS 230, and computer 236 need not be located at the same site as each other or at the same site as the connector assemblies 202 or the inter-networking devices 238.

Also, power can be supplied to the connector assemblies 202 using conventional "Power over Ethernet" techniques specified in the IEEE 802.3af standard, which is hereby incorporated herein by reference. In such an implementation, a power hub 242 or other power supplying device (located near or incorporated into an inter-networking device that is coupled to each connector assembly 202) injects DC power onto one or more of the wires (also referred to here as the "power wires") included in the copper twisted-pair cable used to connect each connector assembly 202 to the associated inter-networking device.

Figure 3:
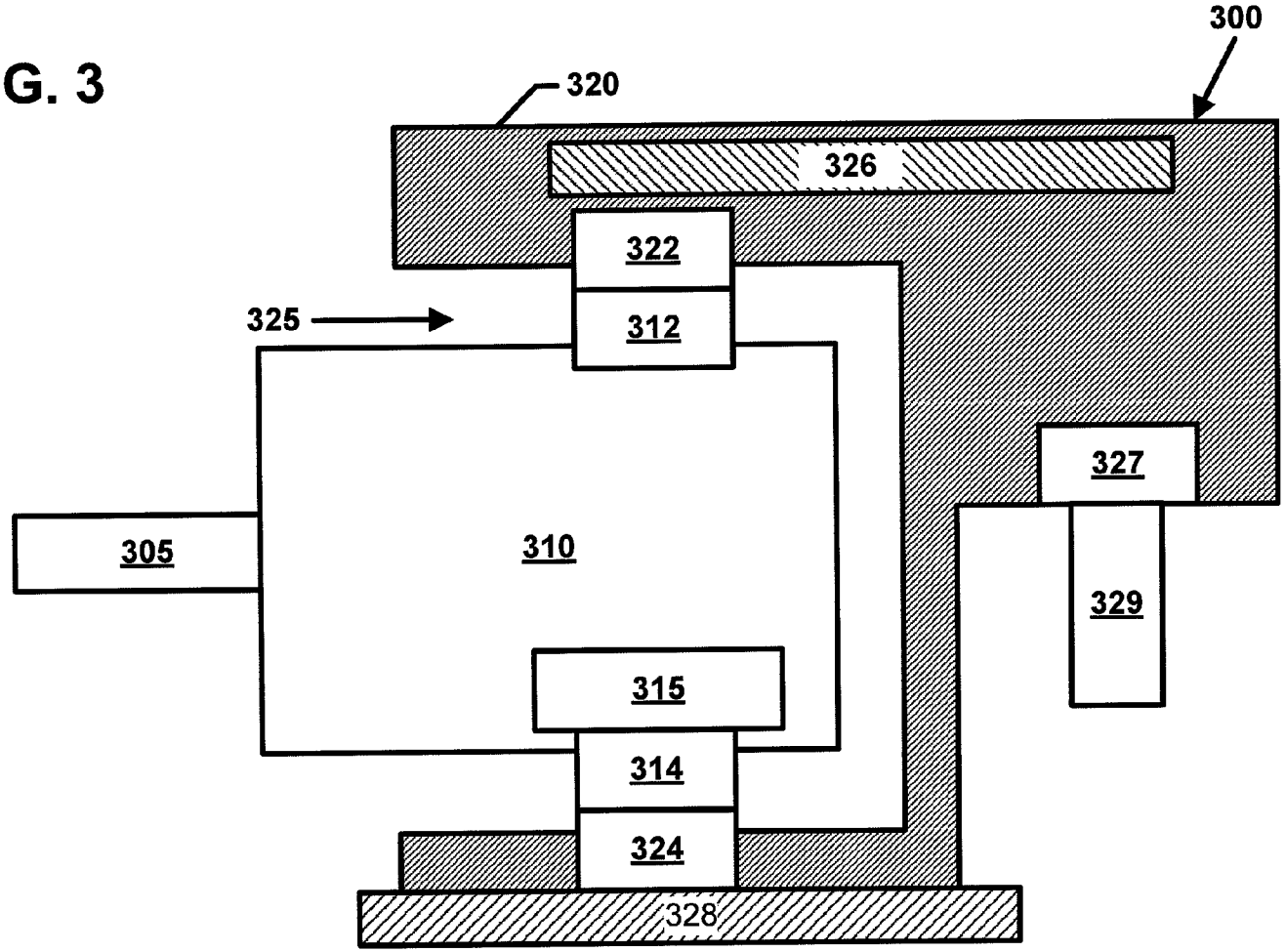
FIG. 3 is a block diagram of one high-level example of a port and media reading interface that are suitable for use in the management system of FIG. 2 in accordance with aspects of the present disclosure.

FIG. 3 is a schematic diagram of one example connection system 300 including a connector assembly 320 configured to collect physical layer information from a connector arrangement 310. The example connection system 300 shown includes a jack module 320 and an electrical plug 310. The connector arrangement 310 terminates at least a first electrical segment (e.g., a conductor cable) 305 of physical communications media and the connector assembly 320 terminates at least second electrical segments (e.g., twisted pairs of copper wires) 329 of physical communications media. The connector assembly 320 defines at least one socket port 325 in which the connector arrangement 310 can be accommodated.

Each electrical segment 305 of the connector arrangement 310 carries communication signals (e.g., communications signals S1 of FIG. 1) to primary contact members 312 on the connector arrangement 310. The connector assembly 320 includes a primary contact arrangement 322 that is accessible from the socket port 325. The primary contact arrangement 322 is aligned with and configured to interface with the primary contact members 312 to receive the communications signals (S1 of FIG. 1) from the primary contact members 312 when the connector arrangement 310 is inserted into the socket 325 of the connector assembly 320.

The connector assembly 320 is electrically coupled to one or more printed circuit boards. For example, the connector assembly 320 can support or enclose a first printed circuit board 326, which connects to insulation displacement contacts (IDCs) 327 or to another type of electrical contacts. The IDCs 327 terminate the electrical segments 329 of physical communications media (e.g., conductive wires). The first printed circuit board 326 manages the primary communication signals carried from the conductors terminating the cable 305 to the electrical segments 329 that couple to the IDCs 327.

In accordance with some aspects, the connector arrangement 310 can include a storage device 315 configured to store physical layer information. The connector arrangement 310 also includes second contact members 314 that are electrically coupled (i.e., or otherwise communicatively coupled) to the storage device 315. In one implementation, the storage device 315 is implemented using an EEPROM (e.g., a PCB surface-mount EEPROM). In other implementations, the storage device 315 is implemented using other non-volatile memory device. Each storage device 315 is arranged and configured so that it does not interfere or interact with the communications signals communicated over the media segment 305.

The connector assembly 320 also includes a second contact arrangement (e.g., a media reading interface) 324. In certain implementations, the media reading interface 324 is accessible through the socket port 325. The second contact arrangement 324 is aligned with and configured to interface with the second contact members 314 of the media segment to receive the physical layer information from the storage device 315 when the connector arrangement 310 is inserted into the socket 325 of the connector assembly 320.

In some such implementations, the storage device interfaces 314 and the media reading interfaces 324 each comprise three (3) leads—a power lead, a ground lead, and a data lead. The three leads of the storage device interface 314 come into electrical contact with three (3) corresponding leads of the media reading interface 324 when the corresponding media segment is inserted in the corresponding port 325. In certain example implementations, a two-line interface is used with a simple charge pump. In still other implementations, additional leads can be provided (e.g., for potential future applications). Accordingly, the storage device interfaces 314 and the media reading interfaces 324 may each include four (4) leads, five (5) leads, six (6) leads, etc.

The storage device 315 also may include a processor or micro-controller, in addition to the storage for the physical layer information. In some example implementations, the micro-controller can be used to execute software or firmware that, for example, performs an integrity test on the cable 305 (e.g., by performing a capacitance or impedance test on the sheathing or insulator that surrounds the cable 305, (which may include a metallic foil or metallic filler for such purposes)). In the event that a problem with the integrity of the cable 305 is detected, the micro-controller can communicate that fact to a programmable processor (e.g., processor 206 of FIG. 2) associated with the port using the storage device interface (e.g., by raising an interrupt). The micro-controller also can be used for other functions.

The connector assembly 320 also can support or enclose a second printed circuit board 328, which connects to the second contact arrangement 324. The second printed circuit board 328 manages the physical layer information communicated from a storage device 315 through second contacts 314, 324. In the example shown, the second printed circuit board 328 is positioned on an opposite side of the connector assembly 320 from the first printed circuit board 326. In other implementations, the printed circuit boards 326, 328 can be positioned on the same side or on different sides. In one implementation, the second printed circuit board 328 is positioned horizontally relative to the connector assembly 320 (see FIG. 3). In another implementation, the second printed circuit board 328 is positioned vertically relative to the connector assembly 320.

The second printed circuit board 328 can be communicatively connected to one or more programmable electronic processors and/or one or more network interfaces. In one implementation, one or more such processors and interfaces can be arranged as components on the printed circuit board 328. In another implementation, one of more such processor and interfaces can be arranged on a separate circuit board that is coupled to the second printed circuit board 328. For example, the second printed circuit board 328 can couple to other circuit boards via a card edge type connection, a connector-to-connector type connection, a cable connection, etc. The network interface is configured to send the physical layer information to the data network (e.g., see signals S2 of FIG. 1).

FIGS. 4-28 provide an example implementation of a connector arrangement 400 in the form of a modular plug 402 for terminating an electrical telecommunications cable 480. The connector arrangement 400 is configured to be received, for signal transmission, within a port of a connector assembly, such as connector assembly 500 (FIGS. 29-36). In accordance with one aspect, the connector arrangement 400 includes a plug 402, such as an RJ plug, that connects to the end of an electrical segment of telecommunications media, such as twisted pair copper cable 480. In one embodiment, a shield can be mounted to the plug nose body 404. For example, the shield can be snap-fit to the plug nose body 404.

The plug 402 includes a plug nose body 404 (FIG. 6-14) configured to hold at least main signal contacts 412. The plug 402 also includes a wire manager 408 for managing the twisted wire pairs and a strain relief boot 410. For example, the plug nose body 404 defines one or more openings 405 in which lugs 409 on the wire manager 408 can latch (see FIG. 5). FIGS. 37-40 show details of one example wire manager 408 and boot 410. In accordance with some aspects, the wire manager 408 and boot 410 are integrally formed. For example, a first portion of the wire manager 408 can be connected to a second portion with a living hinge. In another implementation, the boot 410 can be connected to the wire manager 408 via a rotation-latch mechanism. In other implementations, the boot 410 can otherwise secure to the wire manager 408.

Figure 8:
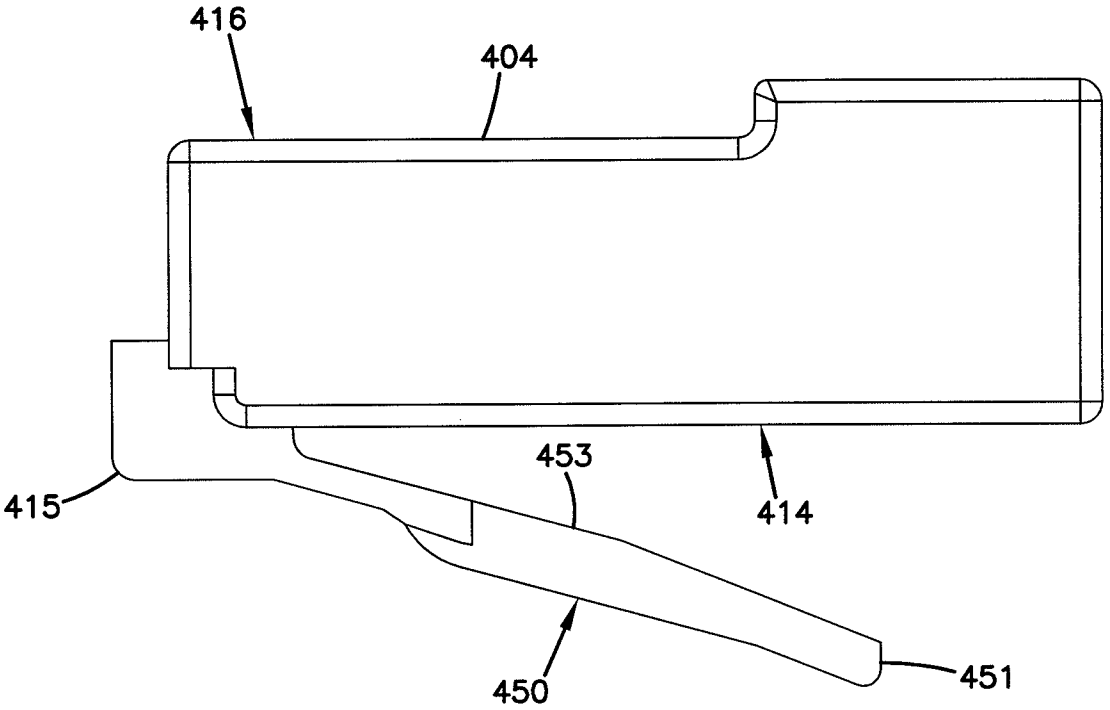
FIG. 8 is a side elevational view of the plug nose body of FIGS. 4-5 in accordance with the principles of the present disclosure.
Figure 9:
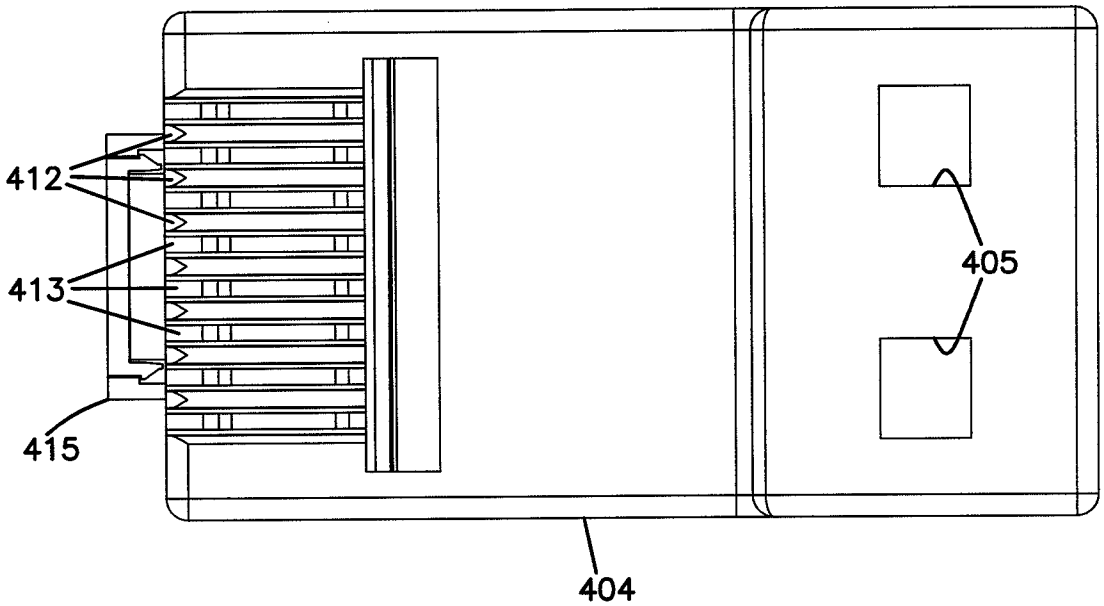
FIG. 9 is a bottom plan view of the plug nose body of FIGS. 4-5 in accordance with the principles of the present disclosure.
Figure 10:
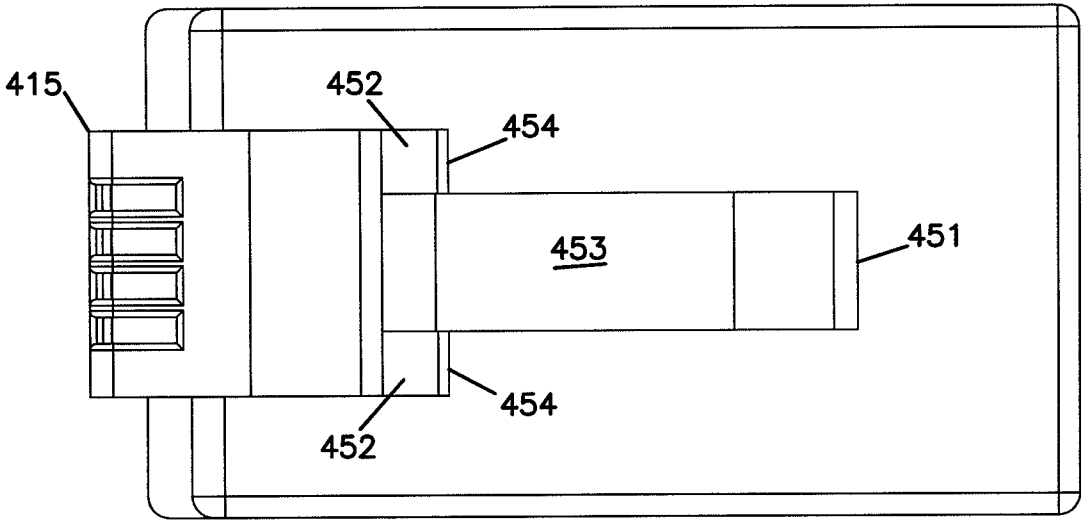
FIG. 10 is a top plan view of the plug nose body of FIGS. 4-5 in accordance with the principles of the present disclosure.
Figure 11:
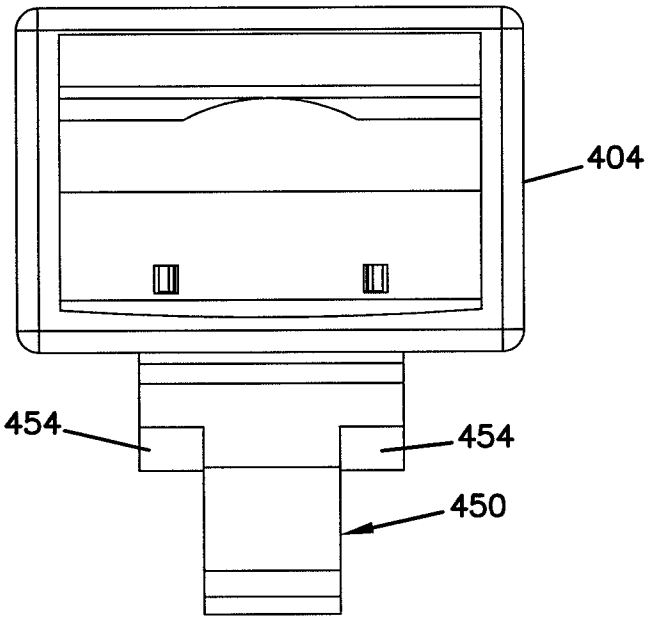
FIG. 11 is a rear view of the plug nose body of FIGS. 4-5 in accordance with the principles of the present disclosure.
Figure 12:
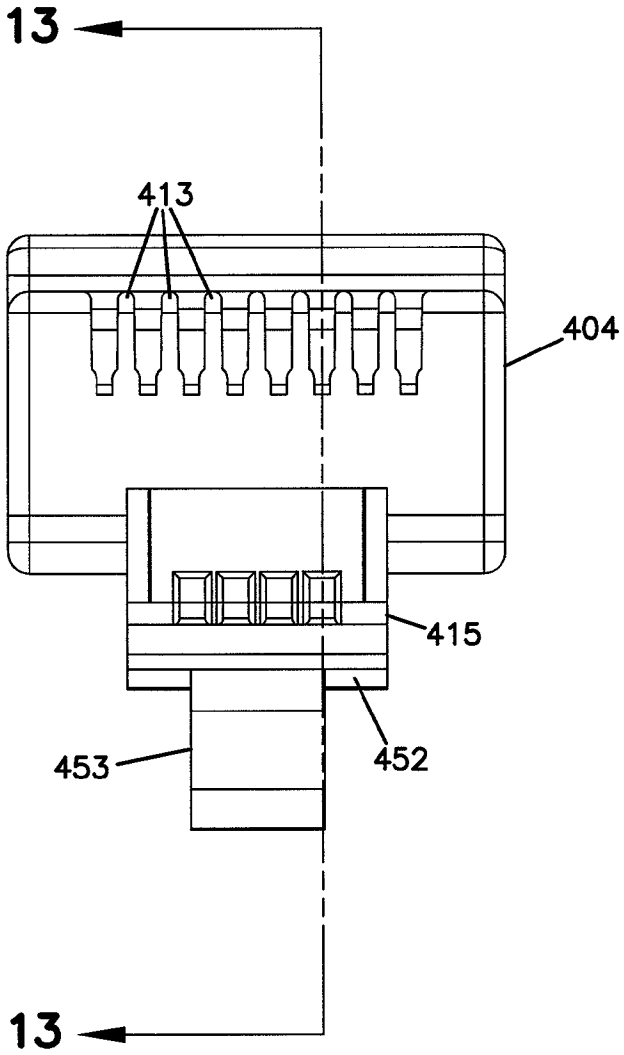
FIG. 12 is a front view of the plug nose body of FIGS. 4-5 in accordance with the principles of the present disclosure.
Figure 13:
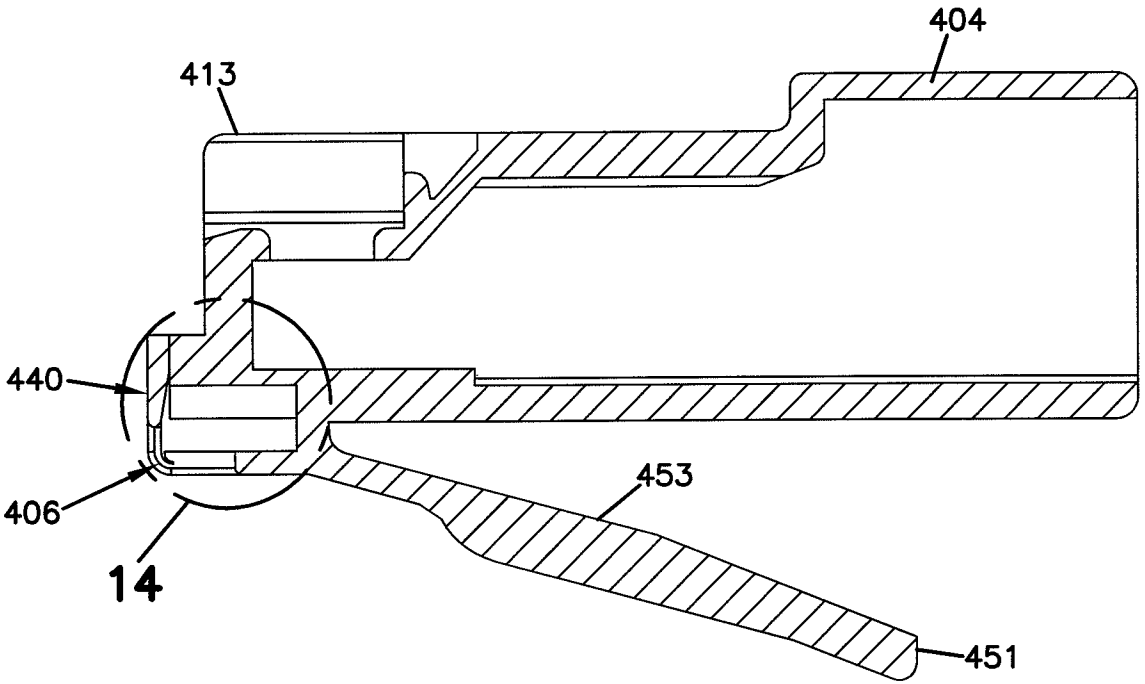
FIG. 13 is a cross-sectional view taken along the 13-13 section line of FIG. 12 in accordance with the principles of the present disclosure.
Figure 14:
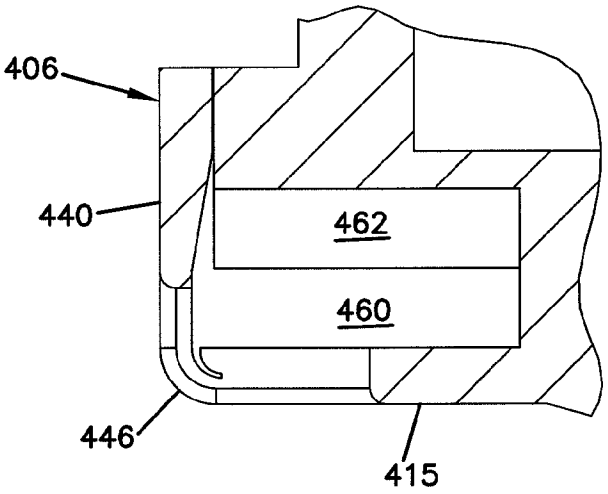
FIG. 14 is an enlarged view of a section of the plug nose body denoted in FIG. 13 in accordance with the principles of the present disclosure.
Figure 25:
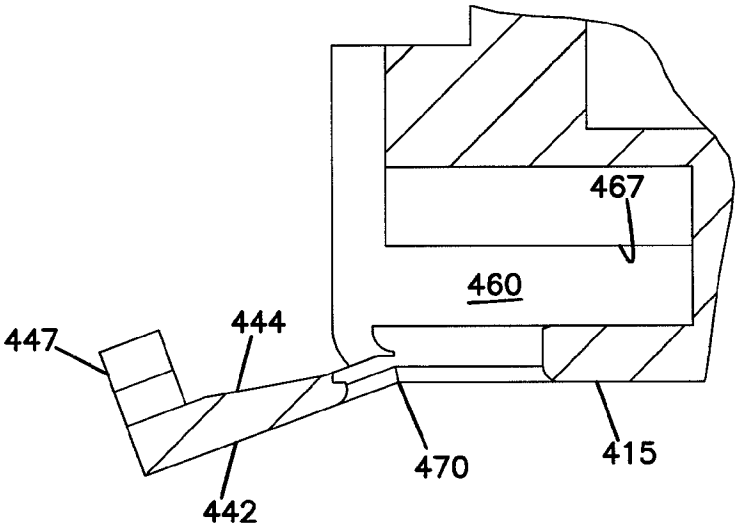
FIG. 25 is an enlarged view of a section of the plug nose body denoted in FIG. 24 in accordance with the principles of the present disclosure.
Figure 15:
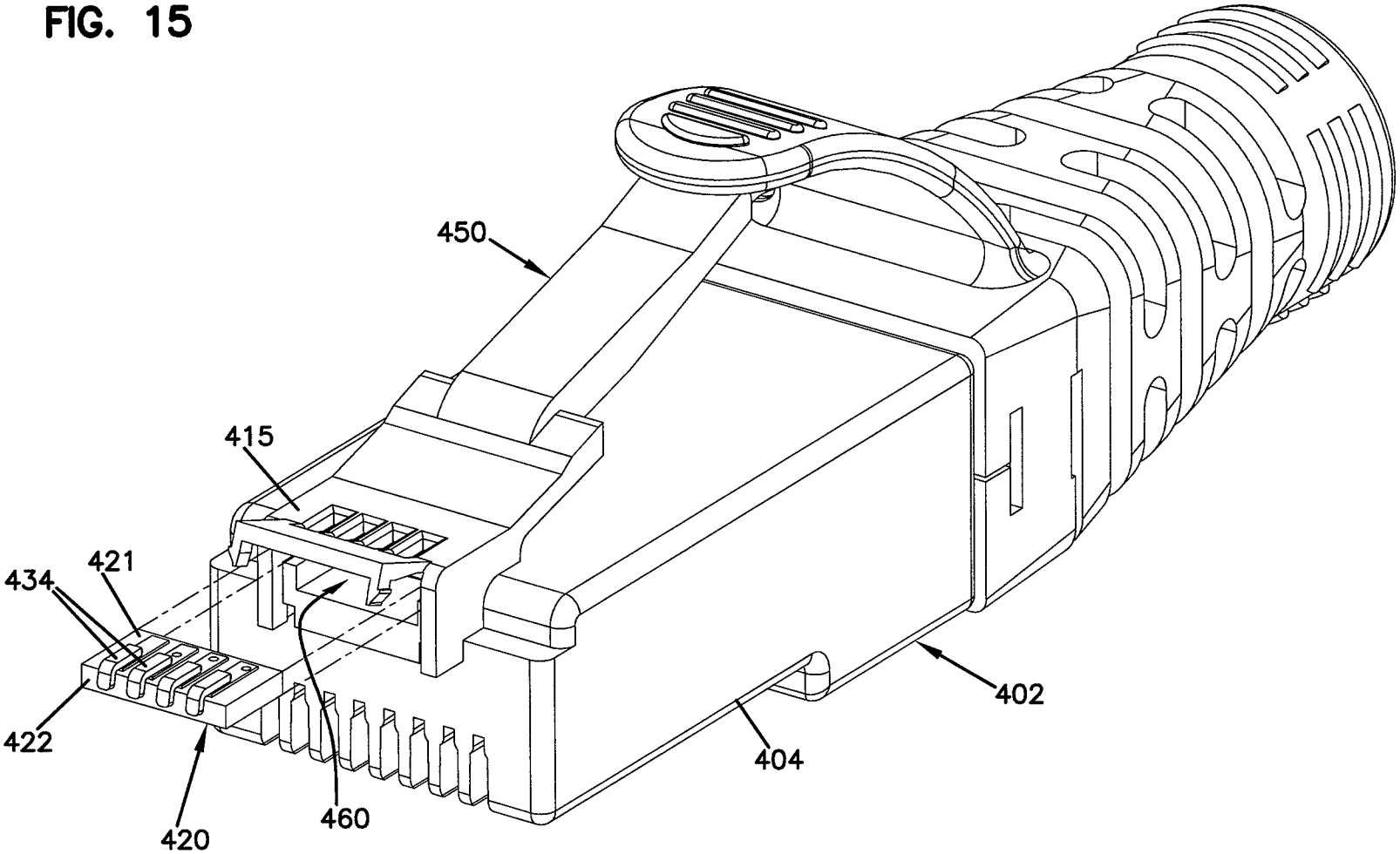
FIGS. 15-16 illustrate perspective views of a connector arrangement including a plug nose body, a wire manager, and a boot with a cover of the plug nose body in an open position and a storage device exploded out from a cavity of the plug nose body in accordance with the principles of the present disclosure.

In the example shown in FIGS. 6-14, the plug nose body 404 has a first side 414 and a second side 416 (FIG. 8). The first side 414 of the plug nose body 404 includes a key member 415 and a finger tab 450 that extends outwardly from the key member 415. The key member 415 and finger tab 450 facilitates aligning and securing the connector arrangement 400 to a connector assembly as will be described in more detail herein. In certain implementations, the finger tab 450 attaches to the plug nose body 404 at the key member 415. In one implementation, the finger tab 450 and at least a portion of the key member 415 are unitary with the plug nose body 404.

The finger tab 450 is sufficiently resilient to enable a distal end 451 of the finger tab 450 to flex or pivot toward and away from the plug nose body 404. Certain types of finger tabs 450 include at least one cam follower surface 452 and a latch surface 454 for latching to the connector assembly as will be described in more detail herein. In certain implementations, the finger tab 450 includes two cam follower surfaces 452 located on either side of a handle extension 453 (see FIG. 6). Depressing the handle extension 453 moves the latch surfaces 454 toward the plug nose body 404. In certain implementations, the wire manager 408 and/or boot 410 include a flexible grip surface 411 that curves over at least the distal end 451 of the handle extension 453 to facilitate depressing of the handle extension 453 (e.g., see FIG. 4).

The second side 416 of the plug nose body 404 is configured to hold main signal contacts 412 (FIG. 28), which are electrically connected to the twisted pair conductors of the telecommunications cable. Ribs 413 protect the main signal contacts 412. In the example shown, the plug 402 is insertable into a port of a mating jack of a connector assembly, such as jack module 510 (see FIG. 29). The main signal contacts 412 electrically connect to contacts positioned in the jack module 510 for signal transmission. In accordance with other aspects, however, the connector arrangement 400 can define other types of electrical connections.

Figure 16:
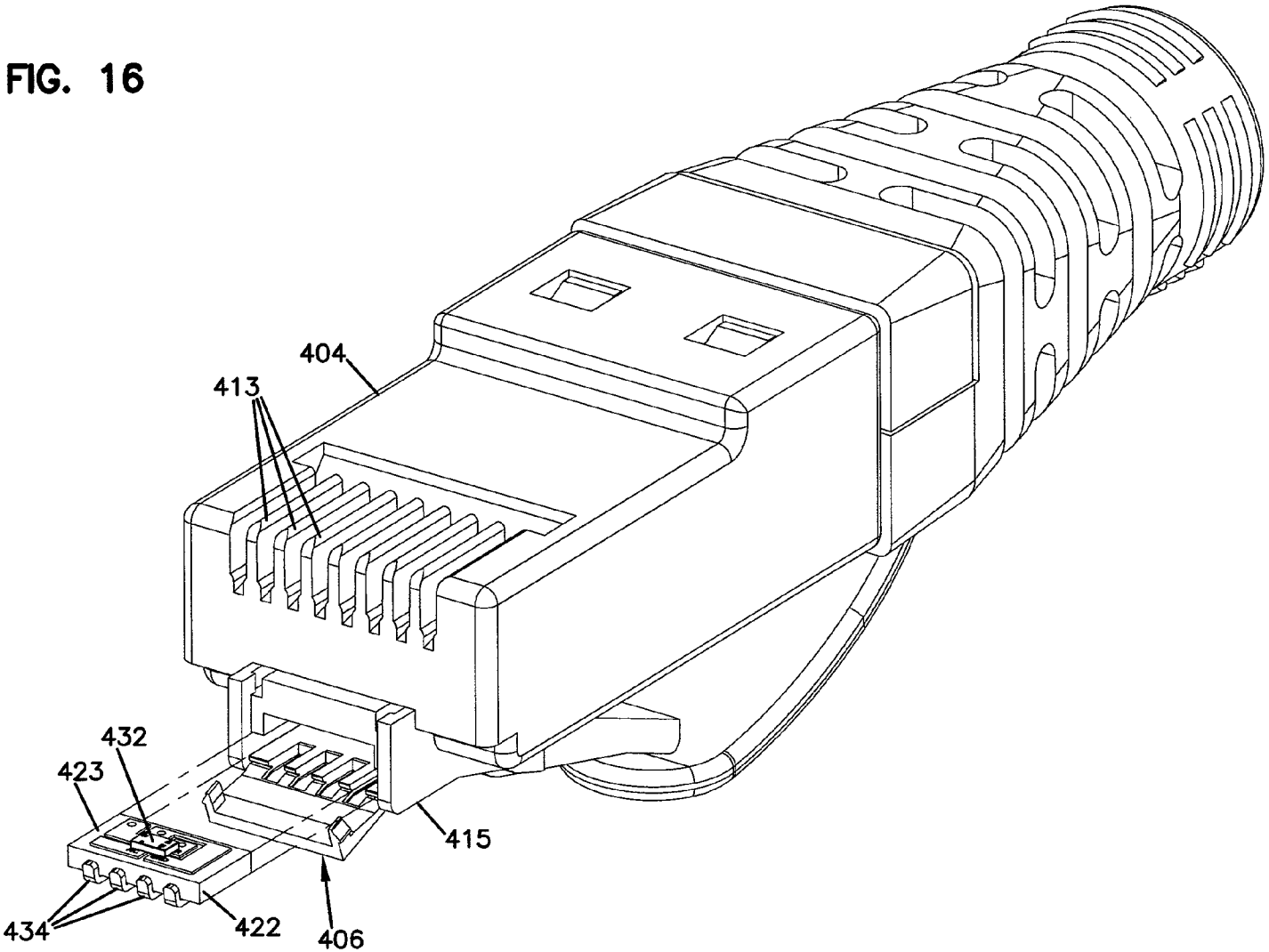
Figure 17:
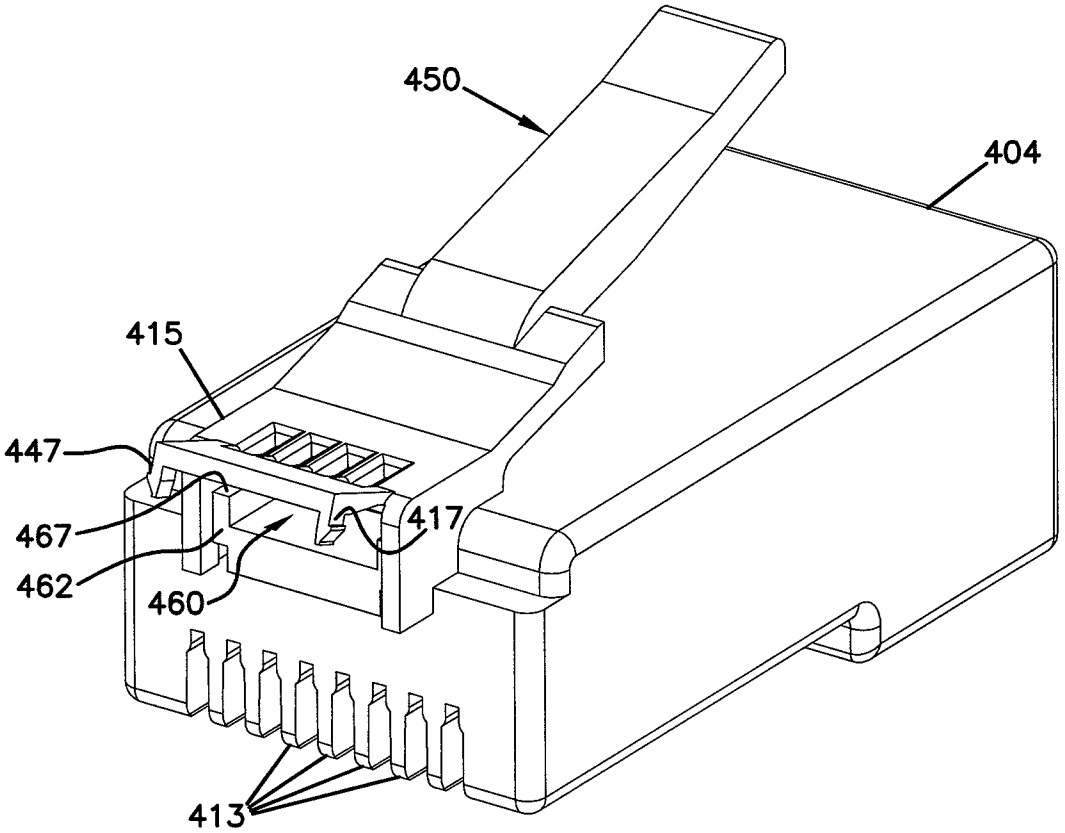
FIG. 17 is a front, top perspective view of the plug nose body of FIGS. 15-16 in accordance with the principles of the present disclosure.
Figure 18:
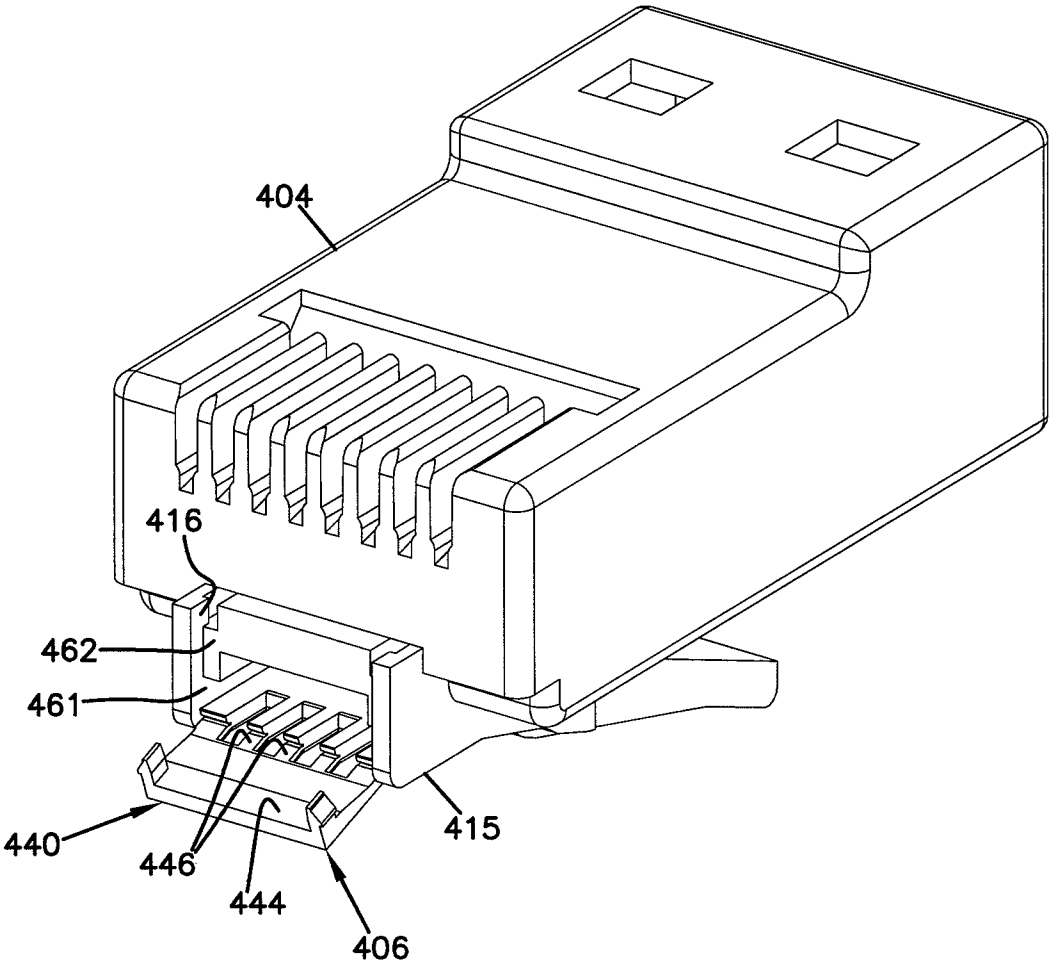
FIG. 18 is a front, bottom perspective view of the plug nose body of FIGS. 15-16 in accordance with the principles of the present disclosure.
Figure 19:
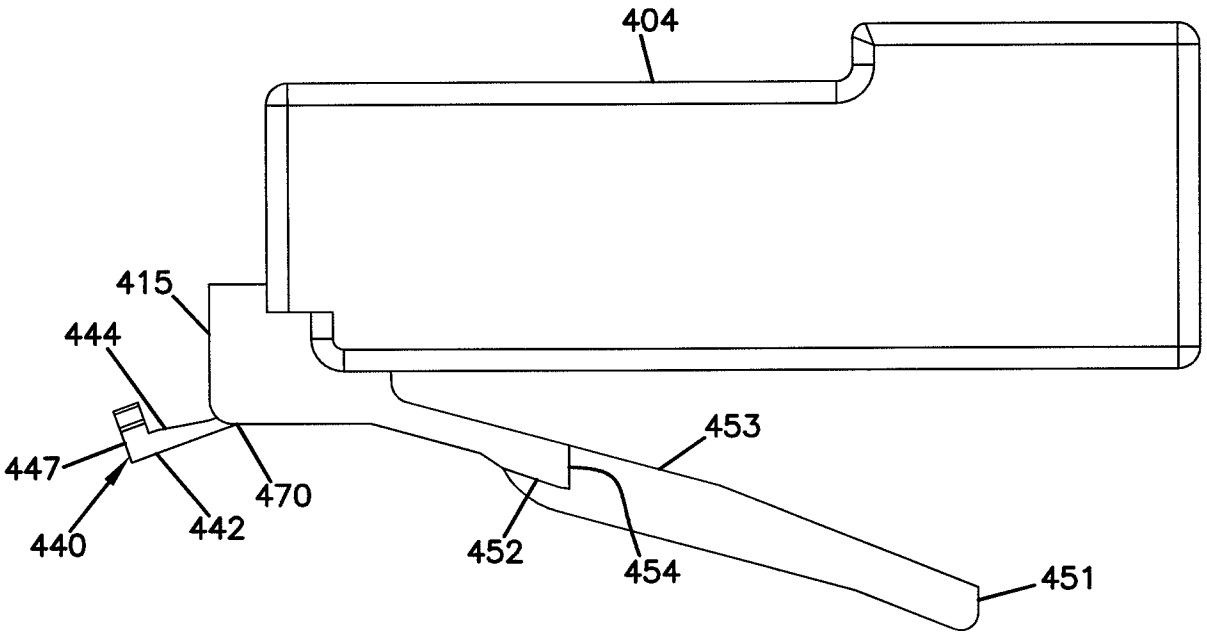
FIG. 19 is a side elevational view of the plug nose body of FIGS. 15-16 in accordance with the principles of the present disclosure.

The connector arrangement 400 also includes a storage device 430 (FIGS. 15 and 16) that is configured to store information (e.g., an identifier, attribute information, physical layer information, etc.) pertaining to the segment of physical communications media (e.g., the plug 402 and/or the electrical cable 480). In one implementation, the media storage device 430 includes an EEPROM 432 (FIG. 16). In other implementations, however, the storage device 430 can include any suitable type of memory.

In some embodiments, the storage device 430 can be positioned on a printed circuit board 420 (FIG. 16). In the example shown, the printed circuit board 420 includes a substrate with conductive traces electrically connecting contacts and lands. The circuit board 420 includes circuit components, including the media storage device 430, at the lands. In the example shown, the circuit board 420 includes an EEPROM 432 at the lands. In certain embodiments, additional components can be arranged on the printed circuit board 420.

In accordance with some aspects, the circuit board 420 defines a body 422 having a first side 421 (FIG. 15) and a second side 423 (FIG. 16). The EEPROM 432 can be mounted to the second side 423 of the circuit board body 422. The circuit contacts 434 are arranged on the first side 421 of the circuit board body 422. The circuit contacts 434 permit connection of the EEPROM 432 to a media reading interface, such as media reading interface 530 of the connector assembly 500 disclosed herein with reference to FIGS. 31-32.

The storage device 430 is mounted to or accommodated within the modular plug 402. For example, the storage device 430 can be mounted to the circuit board 420, which can be positioned on or in the plug nose body 404 of connector arrangement 400. In some implementations, the circuit board 420 is mounted to an exterior surface of the plug body 404. In other implementations, however, the circuit board 420 is mounted within a cavity 460 defined in the plug body 404 (e.g., see FIGS. 26-28).

For example, in certain implementations, the plug nose body 404 defines a cavity 460 (FIG. 23-25) at a front 401 of the body 404. In some implementations, the plug nose body 404 includes a housing member 415 that protrudes forwardly and outwardly from the first surface 414 of the housing plug nose body 404. In the example shown, the housing member 415 forms the base 452 of the finger tab 450. The cavity 460 is defined within the housing member 415. A front of the housing member 415 defines an open front 461 of the cavity 460 providing access to an interior of the cavity 460.

Inner surfaces of the housing member 415 include support members 462 within the cavity 460. The support members 462 define guide grooves 467 in the interior sides of the housing member 415. In the example shown, the printed circuit board 420 can be slid along the guide grooves 467 within the cavity 460 from the open front 461 (see FIGS. 26-28). In other implementations, the printed circuit board 420 can be latched, glued, or otherwise secured within the cavity 460.

Figure 4:
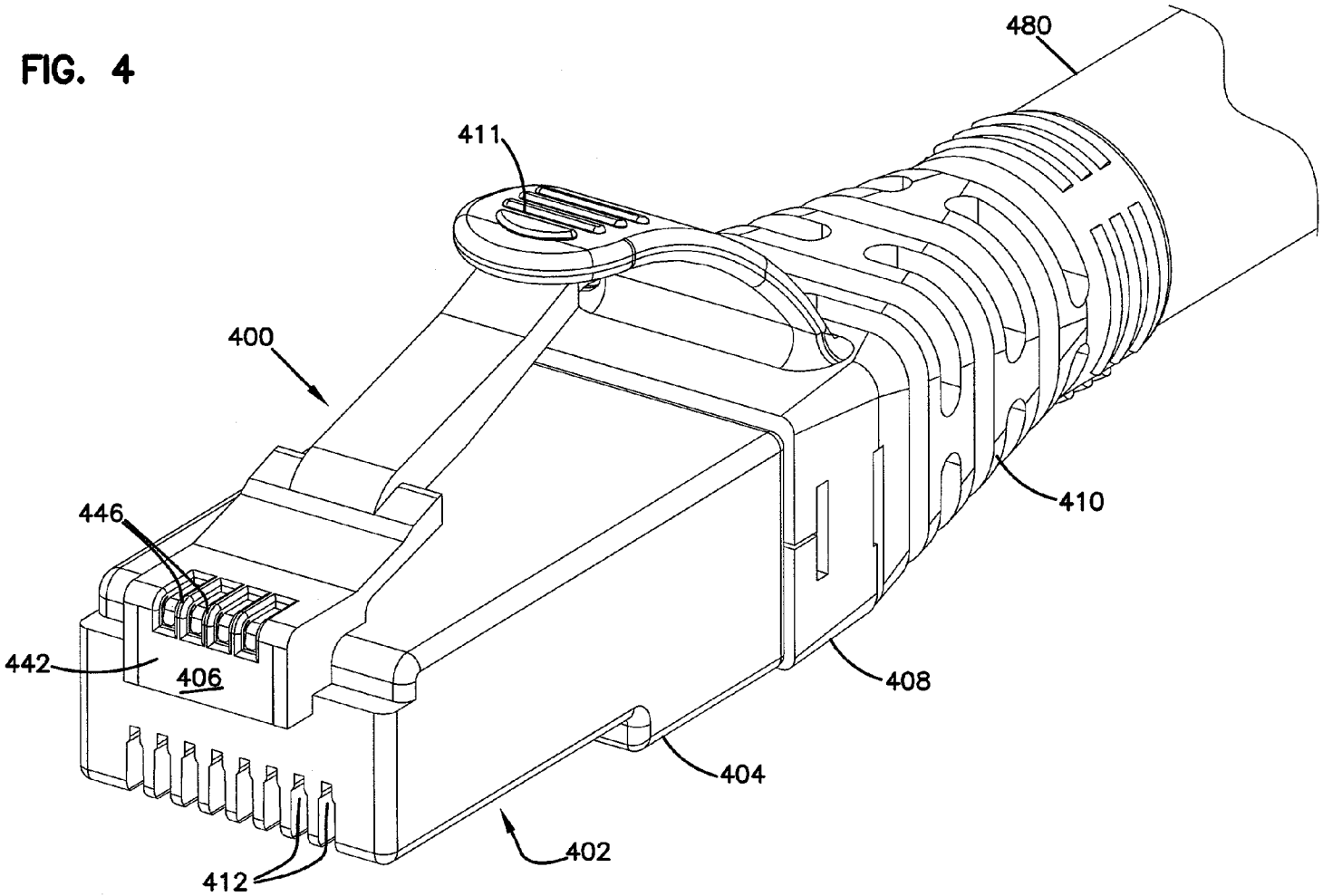
FIGS. 4-5 illustrate perspective views of a connector arrangement including a plug nose body, a wire manager, and a boot in accordance with the principles of the present disclosure.
Figure 5:
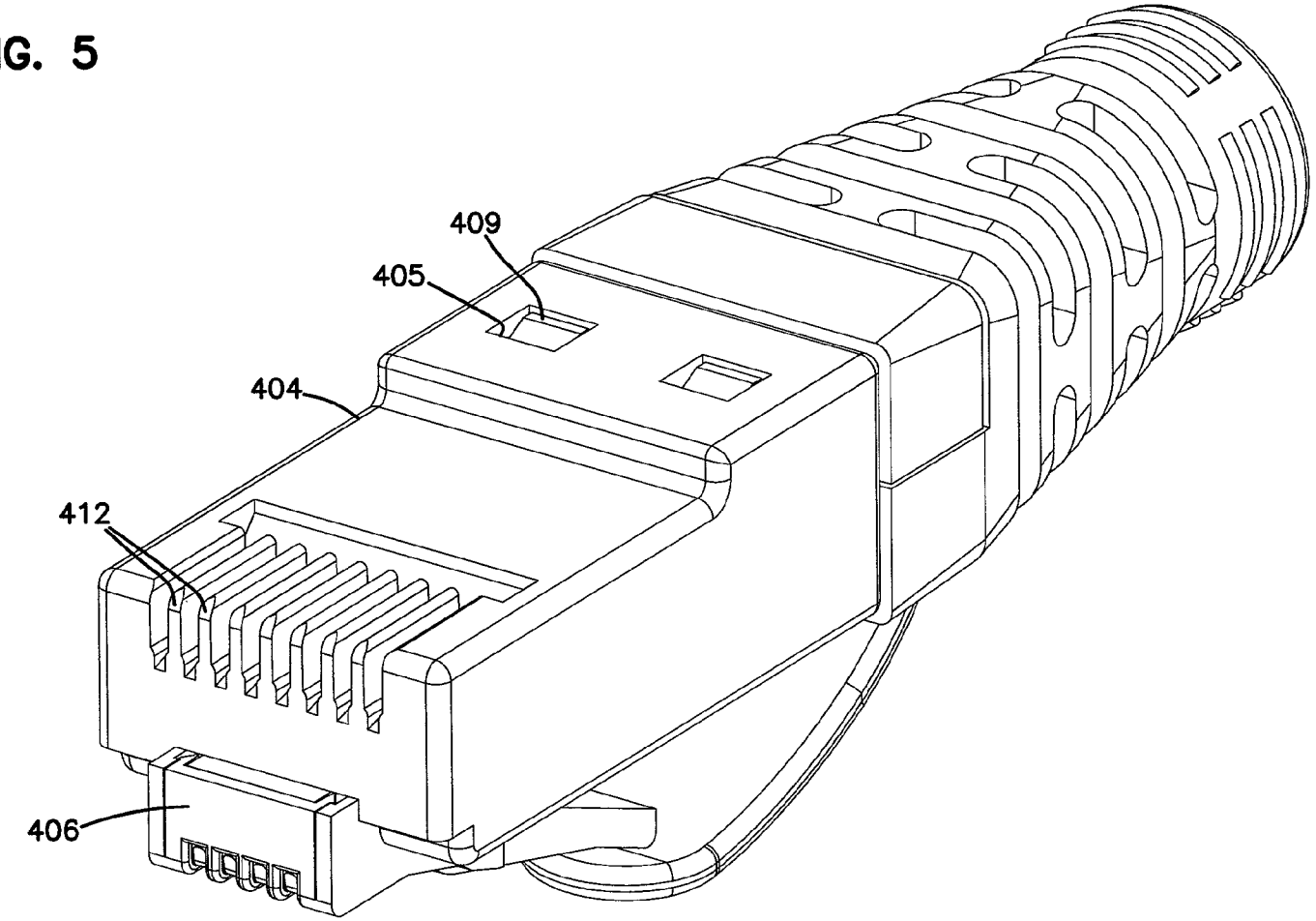
Figure 6:
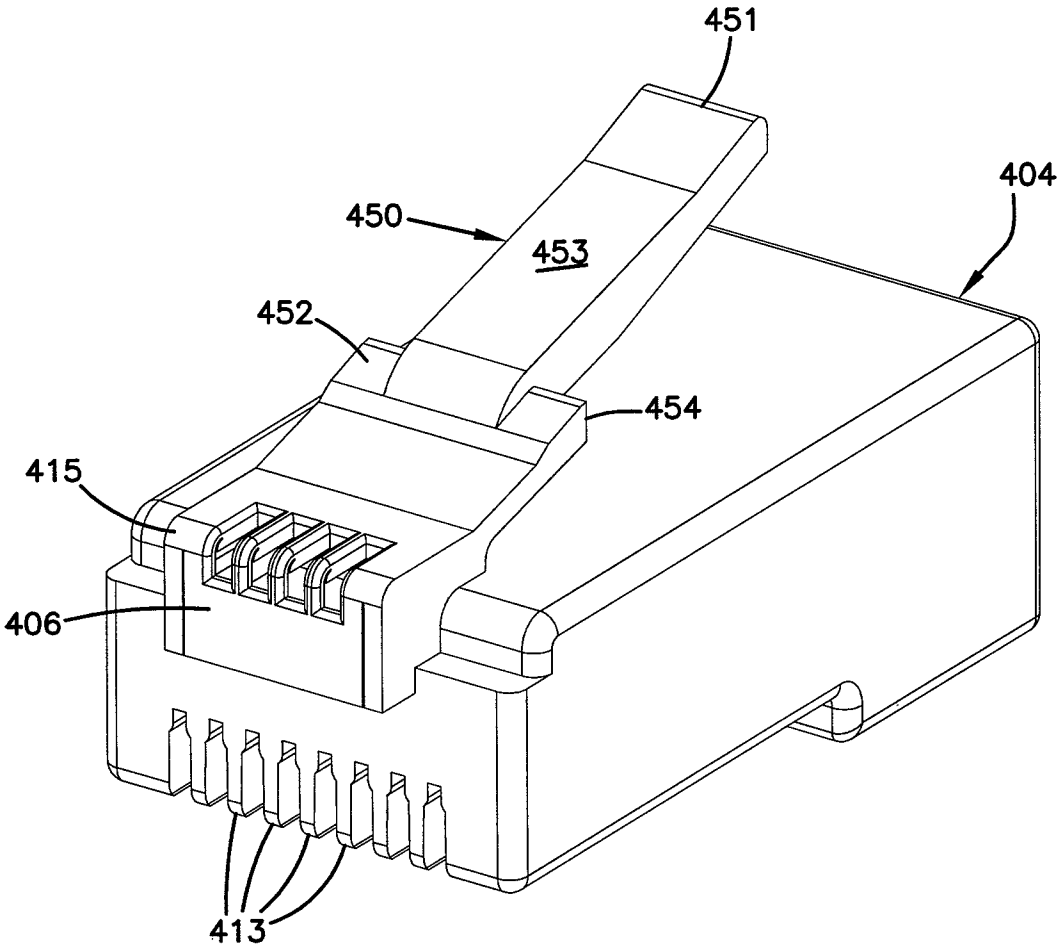
FIG. 6 is a front, top perspective view of the plug nose body of FIGS. 4-5 in accordance with the principles of the present disclosure.
Figure 7:
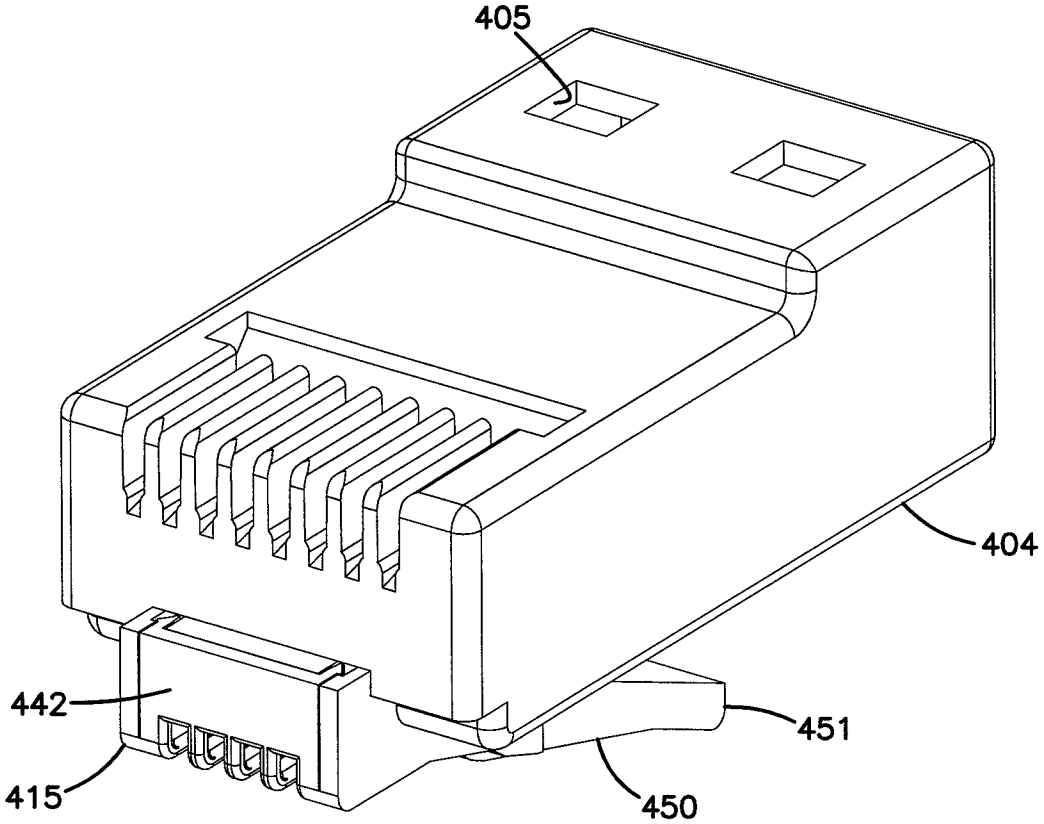
FIG. 7 is a front, bottom perspective view of the plug nose body of FIGS. 4-5 in accordance with the principles of the present disclosure.

The plug body 402 also includes cover section 406 that is configured to selectively enclose the cavity 460 (see FIGS. 4 and 5). For example, in some implementations, at least a portion of the cover section 406 is moveable between an open position and a closed position. When in the open position, the cover section 406 allows access to the cavity 460 through the open front 461 (see FIGS. 26-27). For example, the cover section 406 enables the circuit board 420 and storage device 430 to be mounted within the cavity 460 when the cover section 406 is in the open position (see FIGS. 15 and 16). In the example shown, the cover section 406 extends forwardly of the plug 402 when the cover section 406 is in the open position (see FIGS. 17-21).

When the cover section 406 is in the closed position, however, the cover section 406 inhibits access to the cavity 460 through the front opening 461. For example, the cover section 406 or portion thereof can move to extend over the open front 461 of the cavity 460 when the cover section 406 is moved to the closed position (see FIGS. 4 and 5). In some implementations, an exterior surface 442 of the cover section 406 or portion thereof fits generally flush with the exterior surface of the housing member 415 when the cover section 406 is moved to the closed position (see FIGS. 4-10).

In the example shown, the cover section 406 includes a body 440 defining ribs 446 that extend between the exterior and interior surfaces 442, 444. The ribs 446 provide access to the storage device 430 within the cavity 460 when the cover section 406 is moved to the closed position. For example, in one implementation, contacts of a media reading interface on a patch panel, such as contacts 530 of FIG. 31, can extend through the ribs 446 to connect to the circuit contacts 434 on the storage device 430.

The body 440 of the cover section 406 can define latch arms 447 configured to secure (e.g., lock) the cover section 406 in the closed position (see FIGS. 17-21). In some implementations, the latch arms 447 can latch within the cavity 460 defined in the housing member 415. For example, the latch arms 447 can latch behind the support members 416 (FIG. 18) defined in the cavity 460. In the example shown in FIG. 26, the latch arms 447 are configured to extend beneath the printed circuit board 420 when the board 420 is mounted within the guiding grooves 467 in the cavity 460. In some implementations, the cover section 406 is not releasable once locked in the closed position. In other implementations, the cover section 406 may be releasably locked in the closed position.

Figure 20:
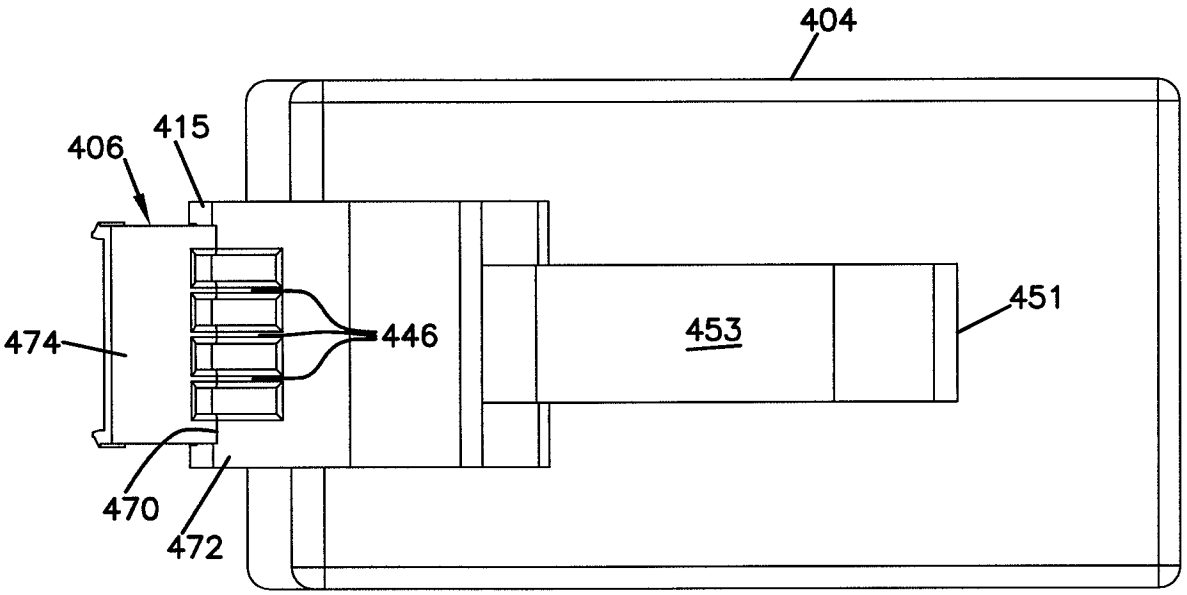
FIG. 20 is a top plan view of the plug nose body of FIGS. 15-16 in accordance with the principles of the present disclosure.
Figure 21:
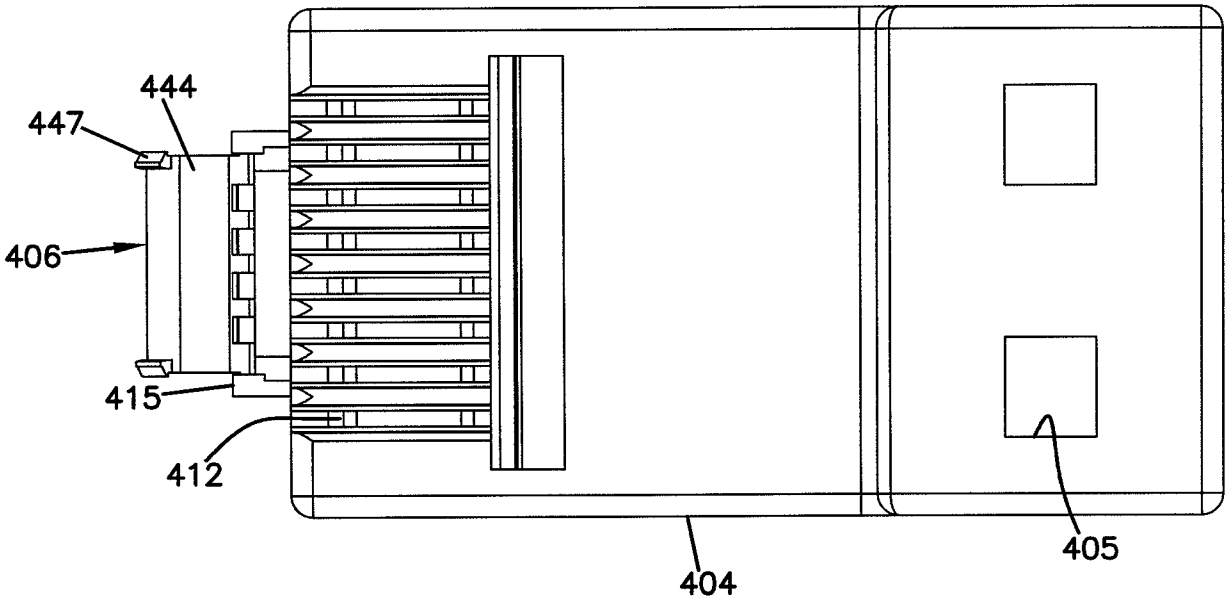
FIG. 21 is a bottom plan view of the plug nose body of FIGS. 15-16 in accordance with the principles of the present disclosure
Figure 22:
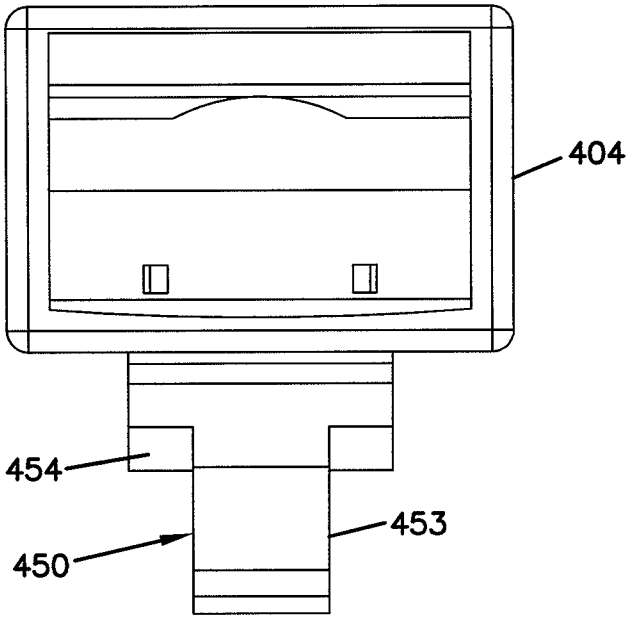
FIG. 22 is a rear view of the plug nose body of FIGS. 15-16 in accordance with the principles of the present disclosure.
Figure 23:
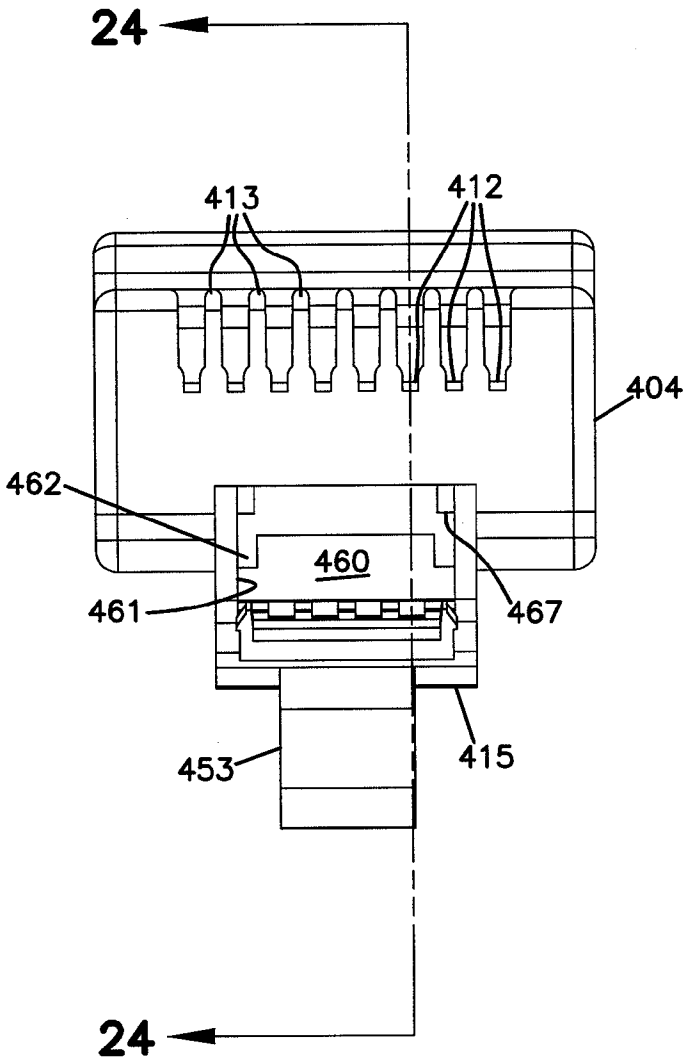
FIG. 23 is a front view of the plug nose body of FIGS. 15-16 in accordance with the principles of the present disclosure.
Figure 24:
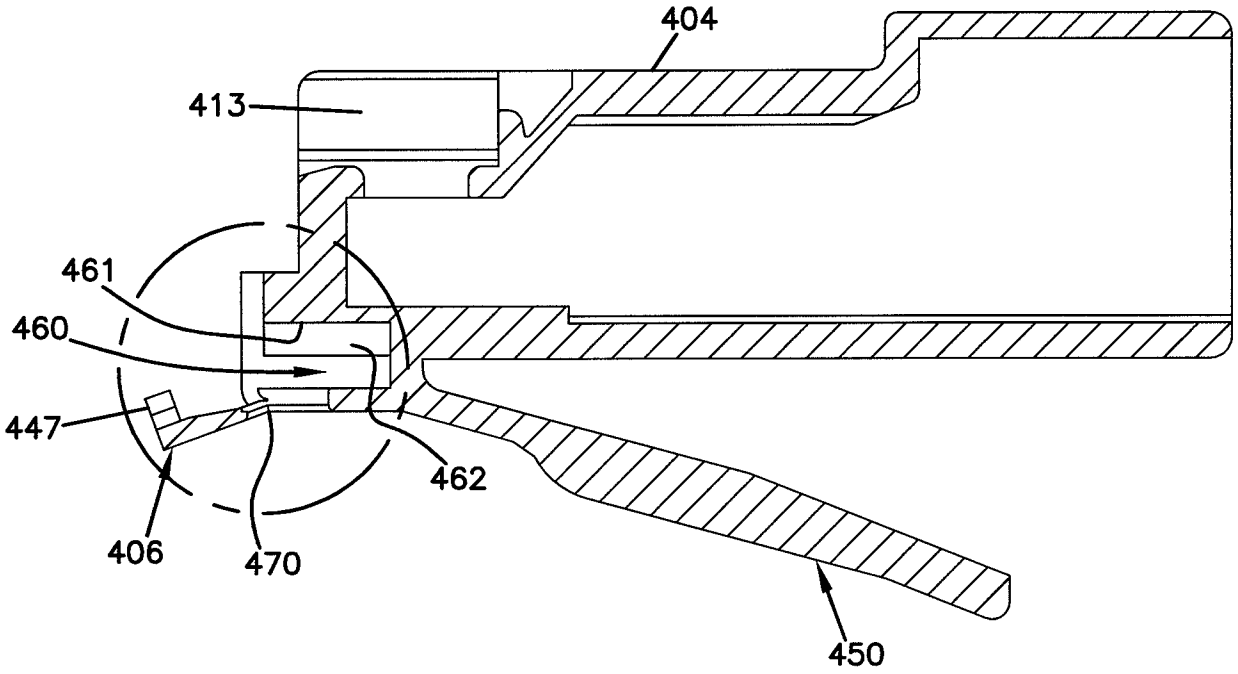
FIG. 24 is a cross-sectional view taken along the 24-24 section line of FIG. 23 in accordance with the principles of the present disclosure.
Figure 26:
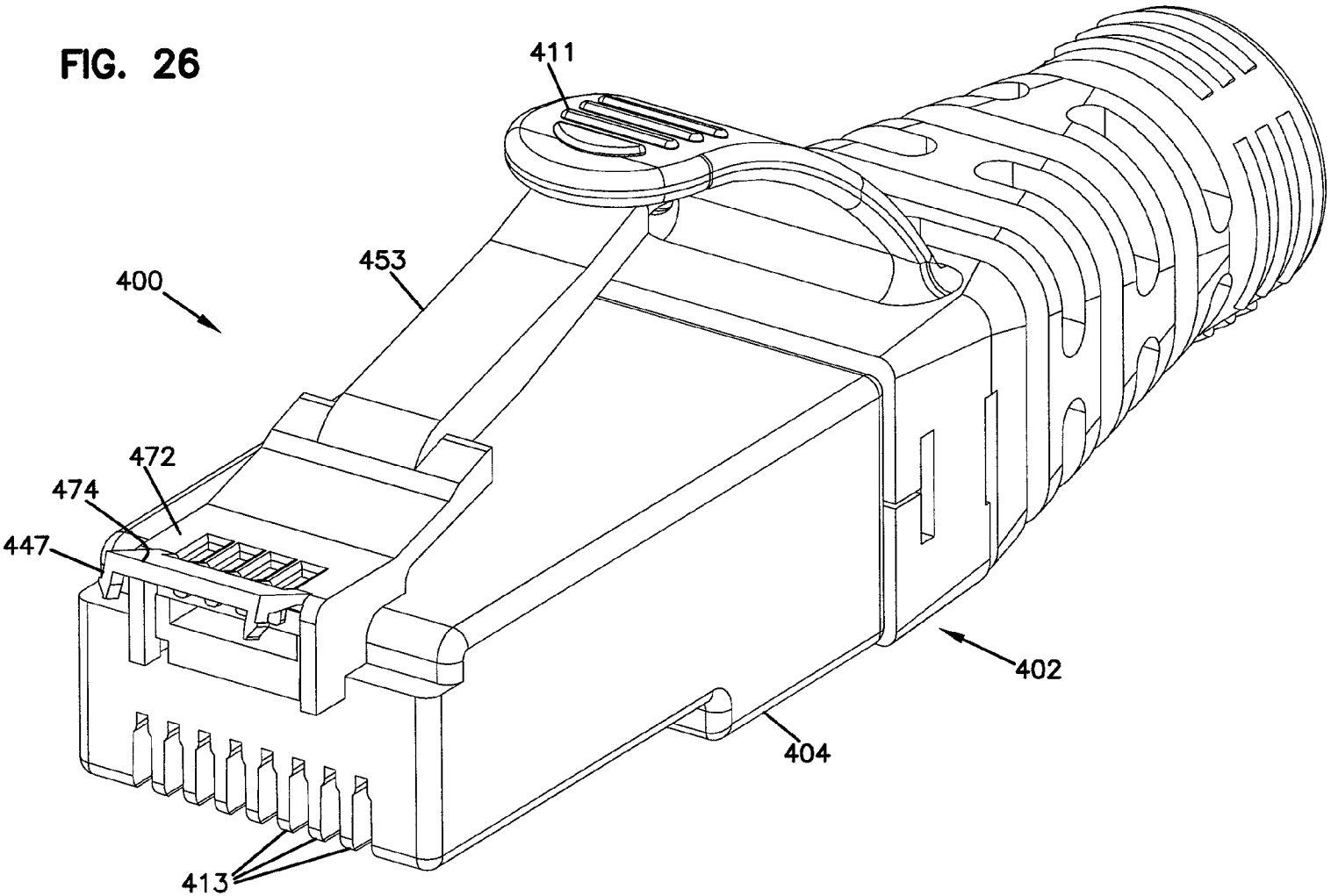
FIG. 26 is a front, top perspective view of the connector arrangement of FIGS. 4-5 with a storage device positioned within a cavity of the plug nose body in accordance with the principles of the present disclosure.
Figure 27:
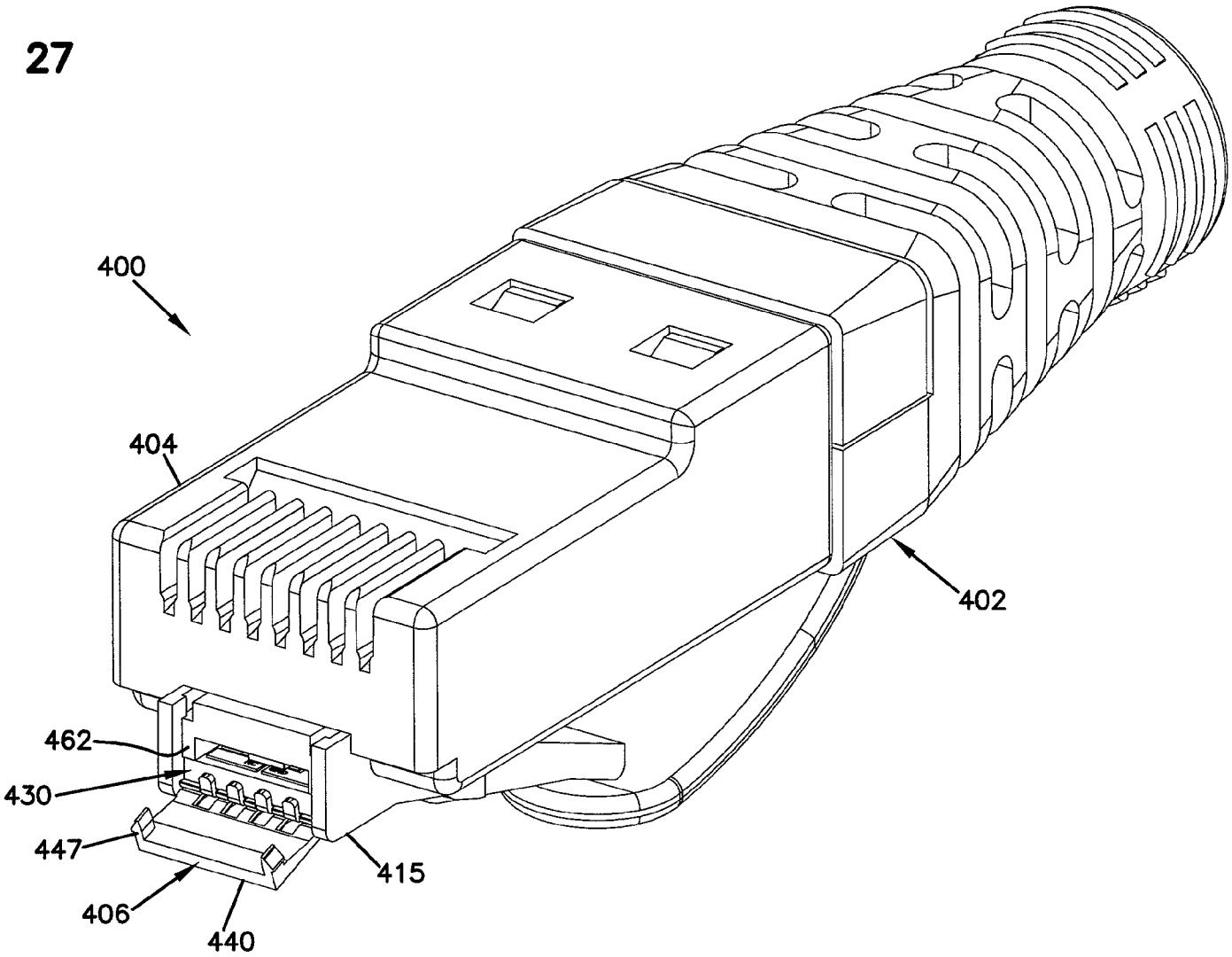
FIG. 27 is a front, bottom perspective view of the connector arrangement of FIG. 26 in accordance with the principles of the present disclosure.
Figure 28:
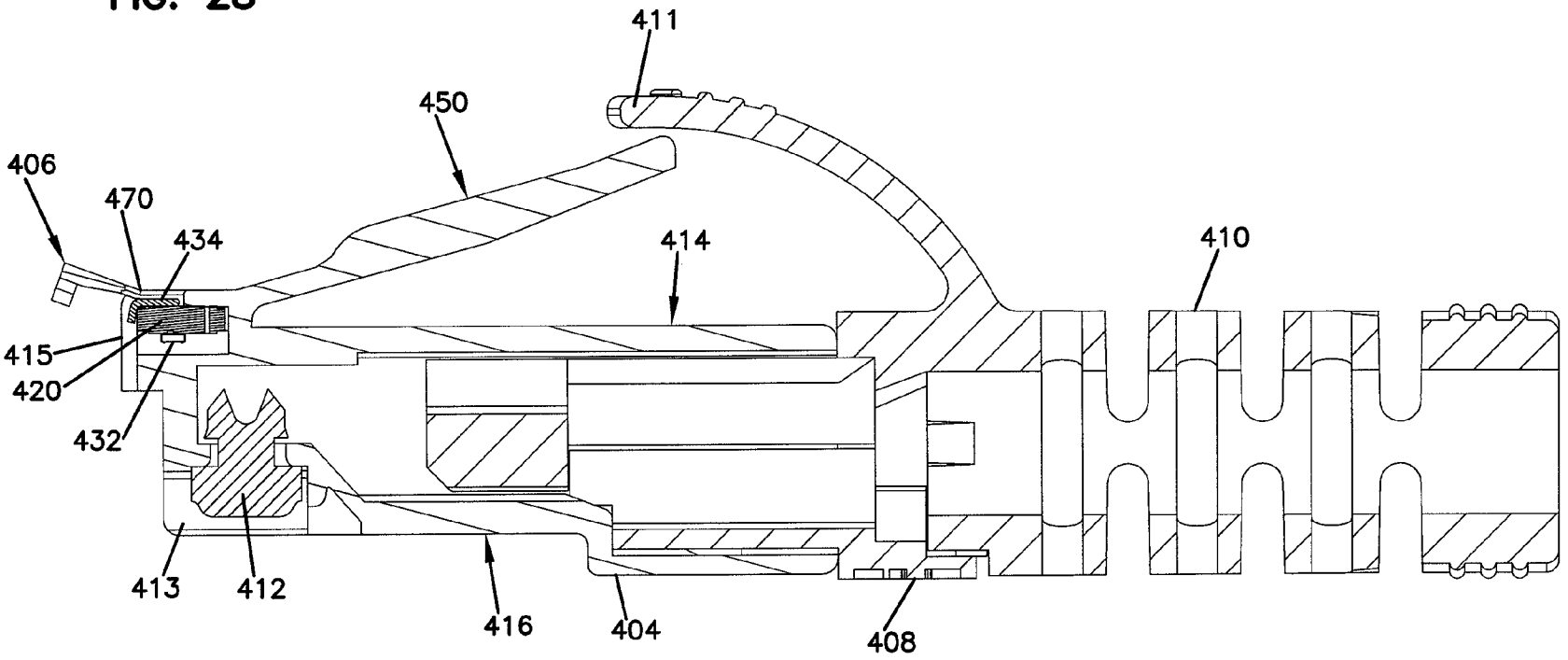
FIG. 28 is a cross-sectional view of the connector arrangement of FIG. 26 in accordance with the principles of the present disclosure.
Figure 29:
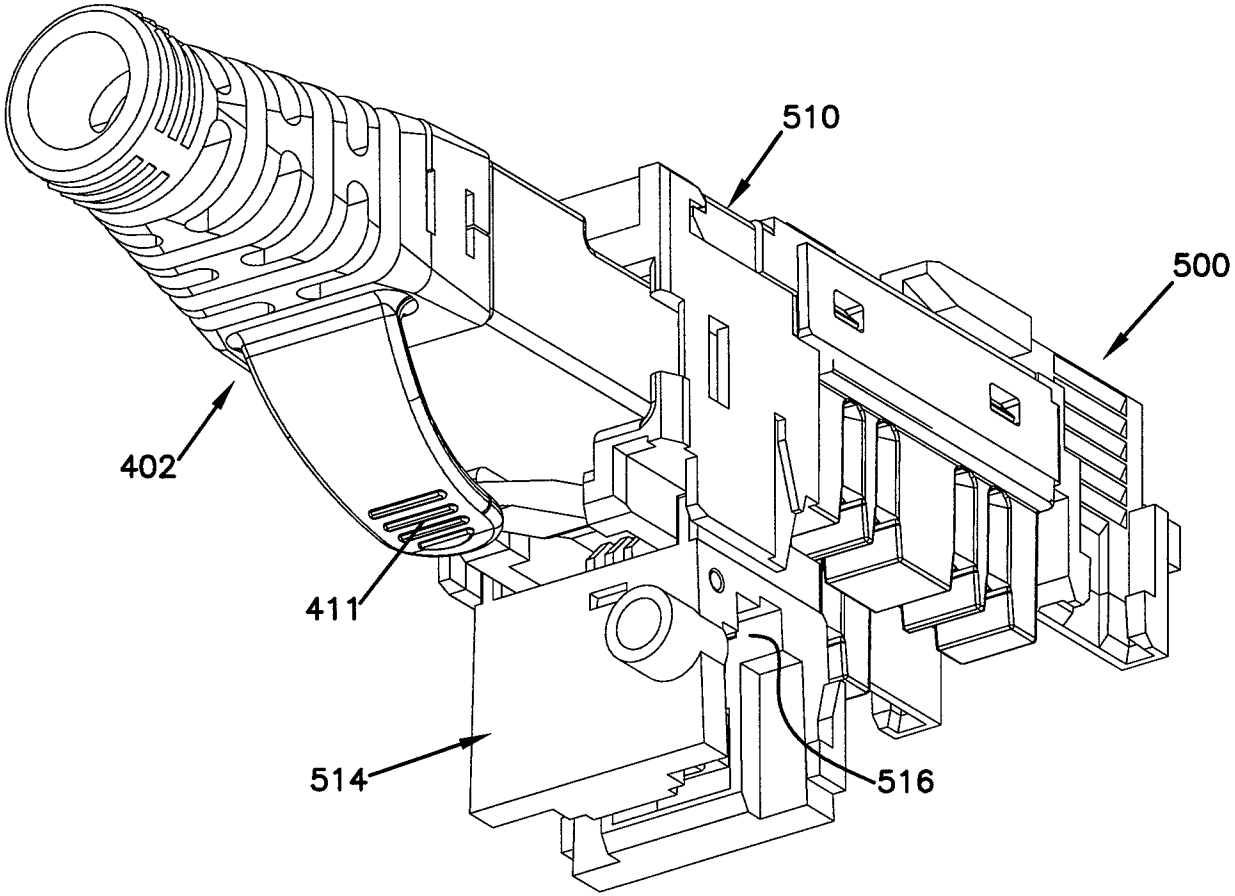
FIG. 29 is a front perspective view of a plug inserted into a jack module with a cover in a closed position over a storage device in accordance with the principles of the present disclosure.
Figure 30:
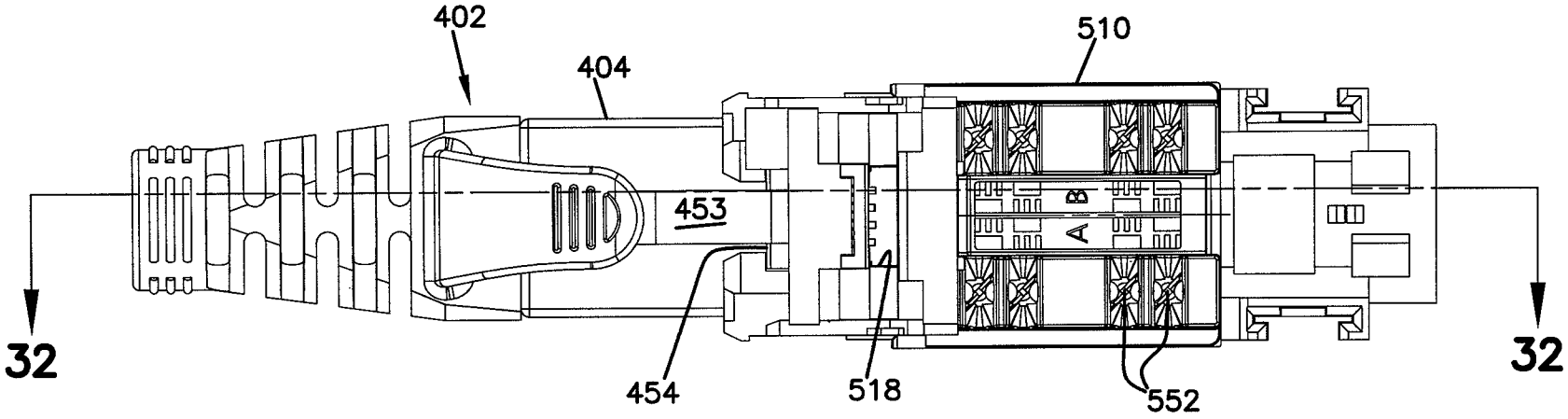
FIG. 30 is a bottom plan view of the plug and jack module of FIG. 29 in accordance with the principles of the present disclosure.

In accordance with some aspects, the cover section 406 defines a living hinge 470 (FIGS. 19, 20, 28) that enables the cover section 406 to move (e.g., pivot or rotate) from the open position to the closed position. The living hinge 470 separates the cover section 406 into a first section 472 and a second section 474 (FIG. 20). The first section 472 remains fixed relative to the plug nose body 402. The second section 474 moves between the open and closed positions. In the example shown, the living hinge 470 is defined at an intermediate portion of the ribs 446 so that a portion of the ribs 446 remain fixed relative to the cavity 460 and another portion of the ribs 446 move relative to the cavity 460 (see FIGS. 18 and 20).

Figure 31:
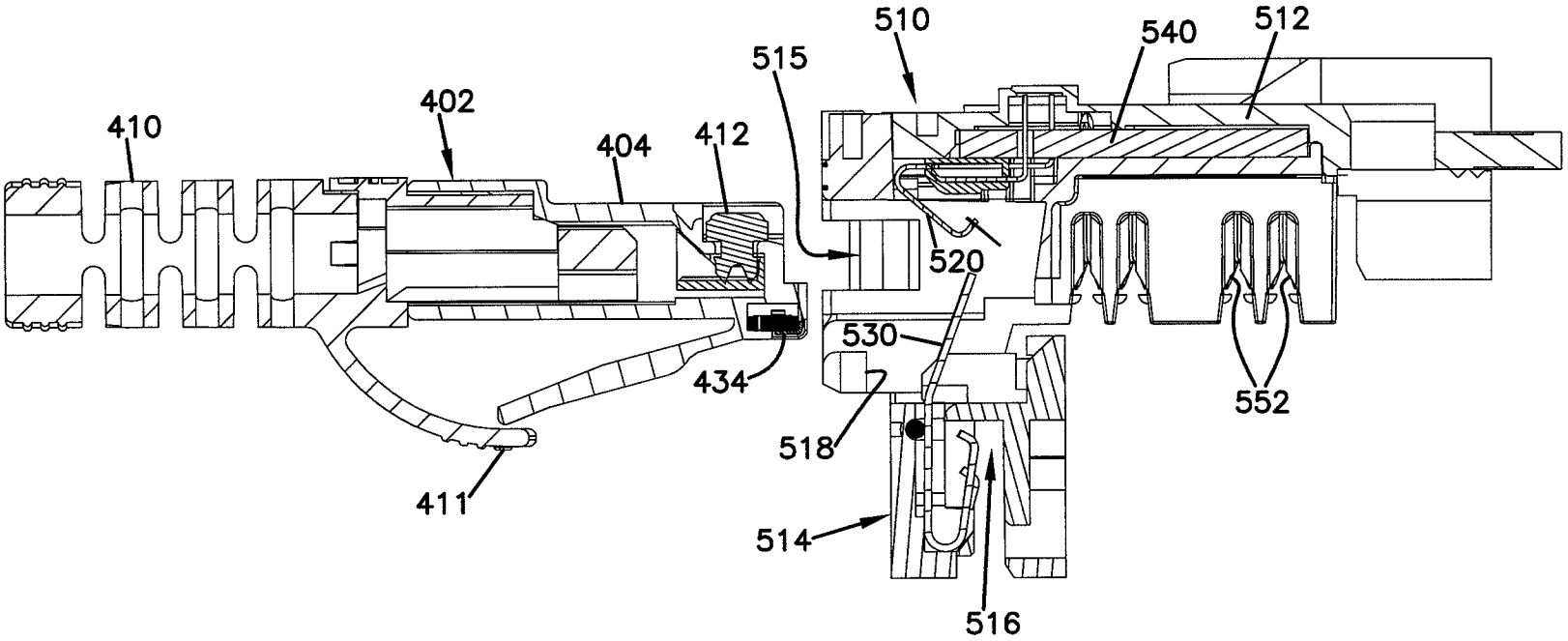
FIG. 31 is a cross-sectional view of the plug and jack module of FIG. 29 prior to insertion of the plug into the jack module in accordance with the principles of the present disclosure.

FIGS. 29-32 show one example connector arrangement 400 (e.g., plug 402) inserted in a connector assembly 500. The example connector assembly 500 shown includes a jack module 510 defining a socket 515 (FIG. 31). The jack module 510 is configured to receive the plug 402 within the socket 515 (see FIG. 32). The jack module 500 also includes or accommodates a first set of contacts 520 and a second set of contacts 530 (FIG. 31). In the example shown, the second set of contacts 530 is located on an opposite side of the jack 510 from the first set of contacts 520.

Figure 32:
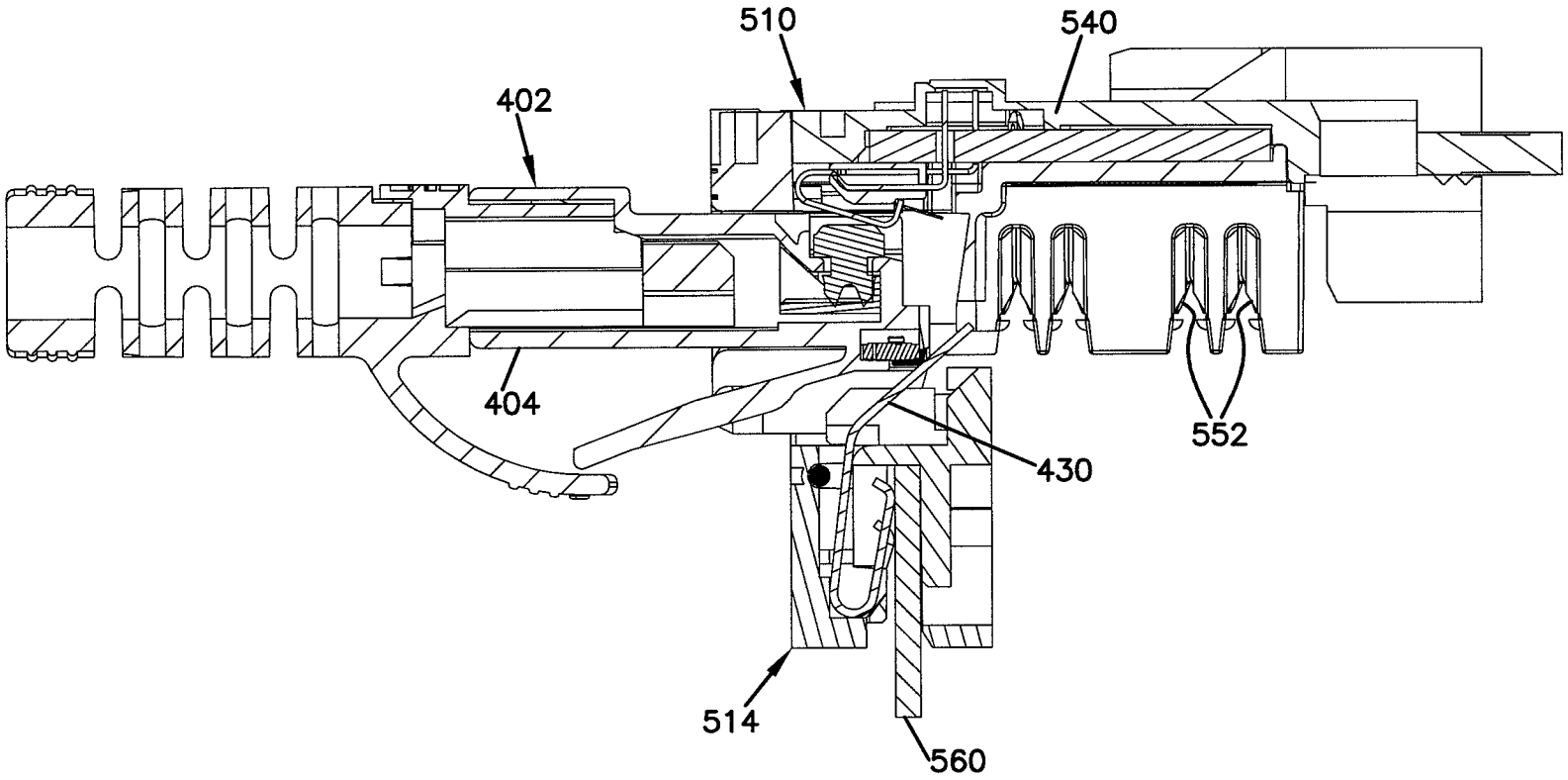
FIG. 32 is a cross-sectional view taken along the section line 32-32 in FIG. 30 in accordance with the principles of the present disclosure.
Figure 33:
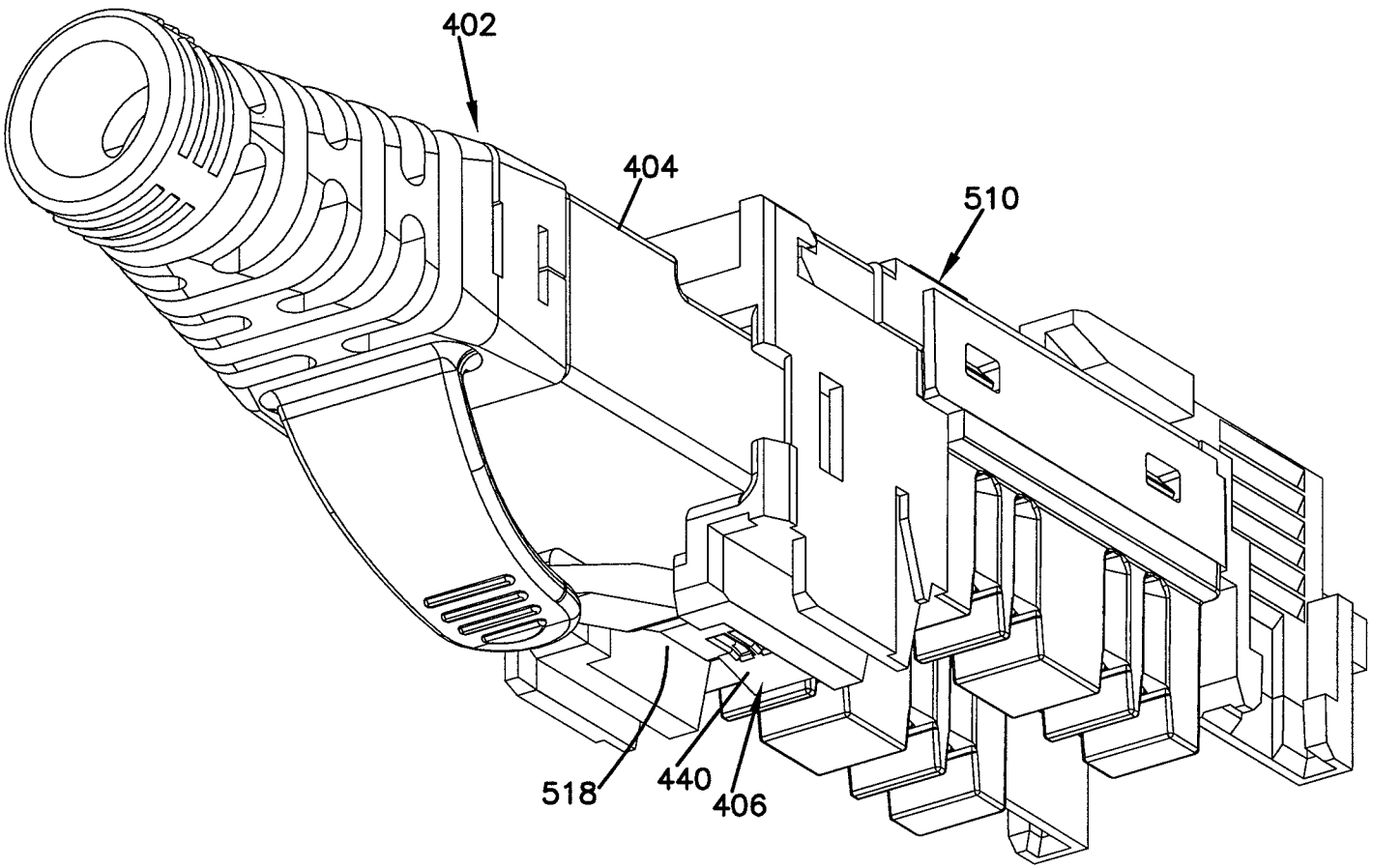
FIG. 33 is a front perspective view of a plug inserted into a jack module with a cover in an open position in accordance with the principles of the present disclosure.
Figure 34:
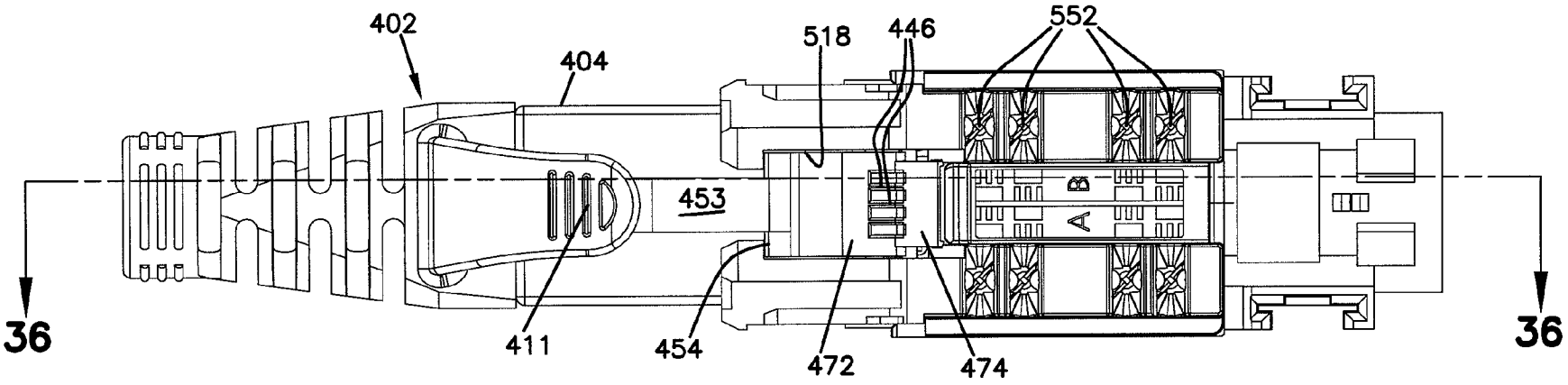
FIG. 34 is a bottom plan view of the plug and jack module of FIG. 33 in accordance with the principles of the present disclosure.
Figure 35:
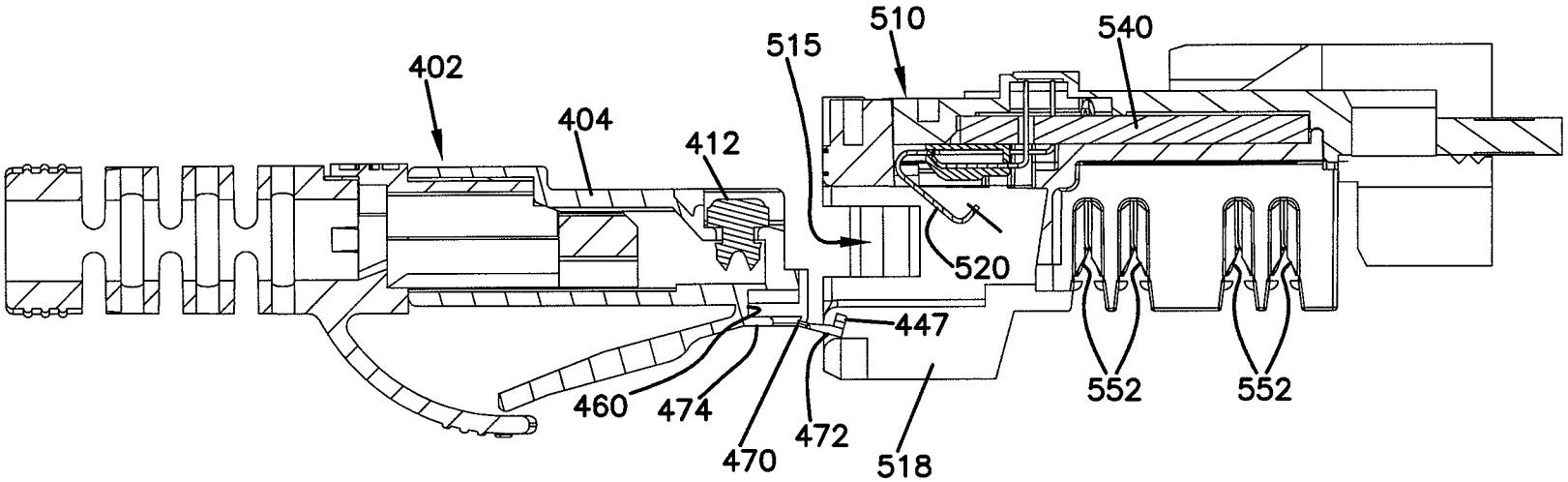
FIG. 35 is a cross-sectional view of the plug and jack module of FIG. 33 prior to insertion of the plug into the jack module in accordance with the principles of the present disclosure.
Figure 36:
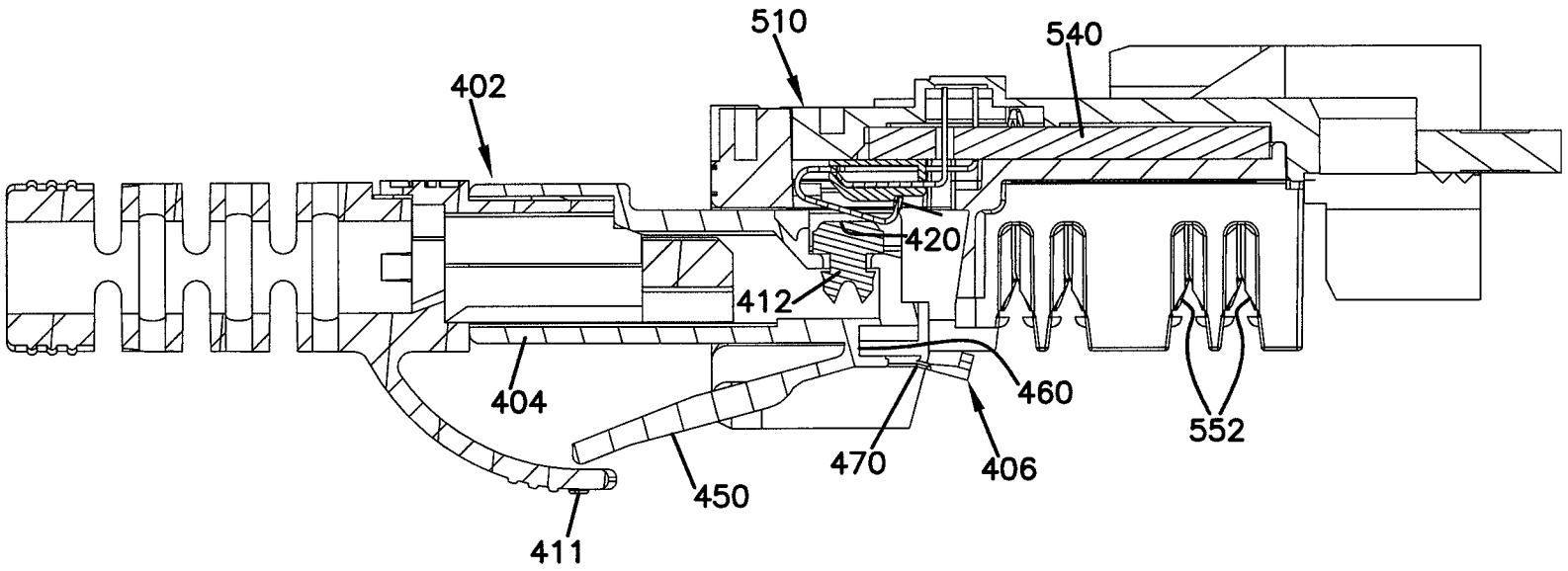
FIG. 36 is a cross-sectional view taken along the section line 36-36 in FIG. 34 in accordance with the principles of the present disclosure.
Figure 37:
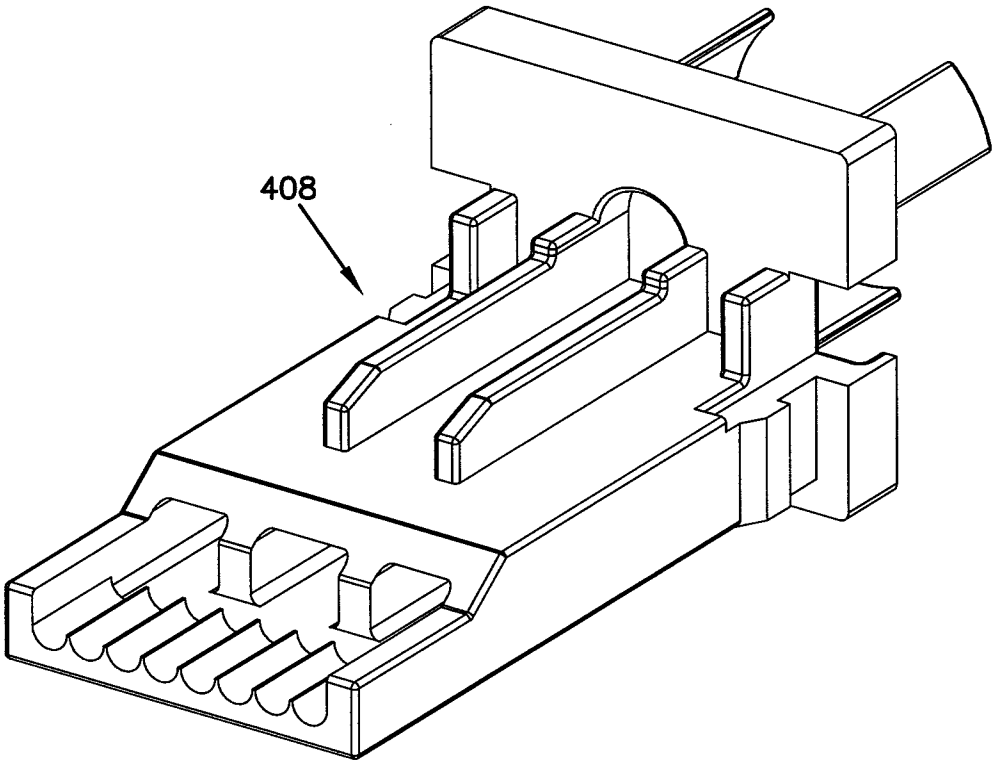
FIGS. 37-38 are perspective views of an example wire manager in accordance with the principles of the present disclosure.
Figure 38:
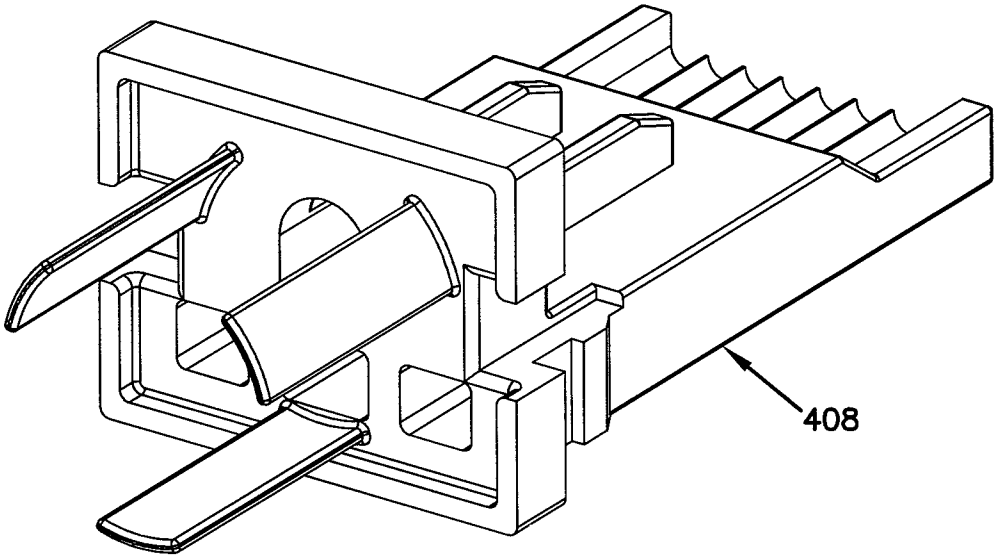
Figure 39:
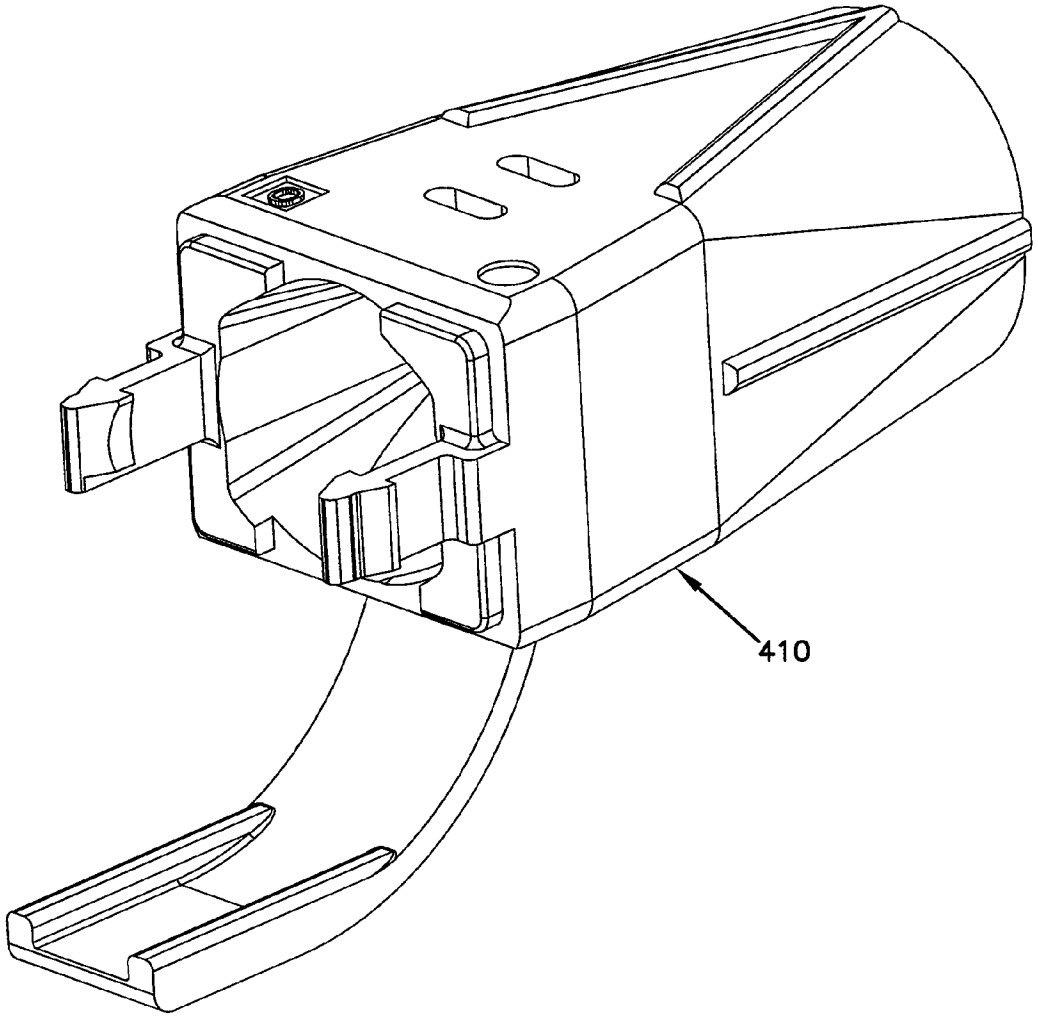
FIGS. 39-40 are perspective views of an example boot in accordance with the principles of the present disclosure.
Figure 40:
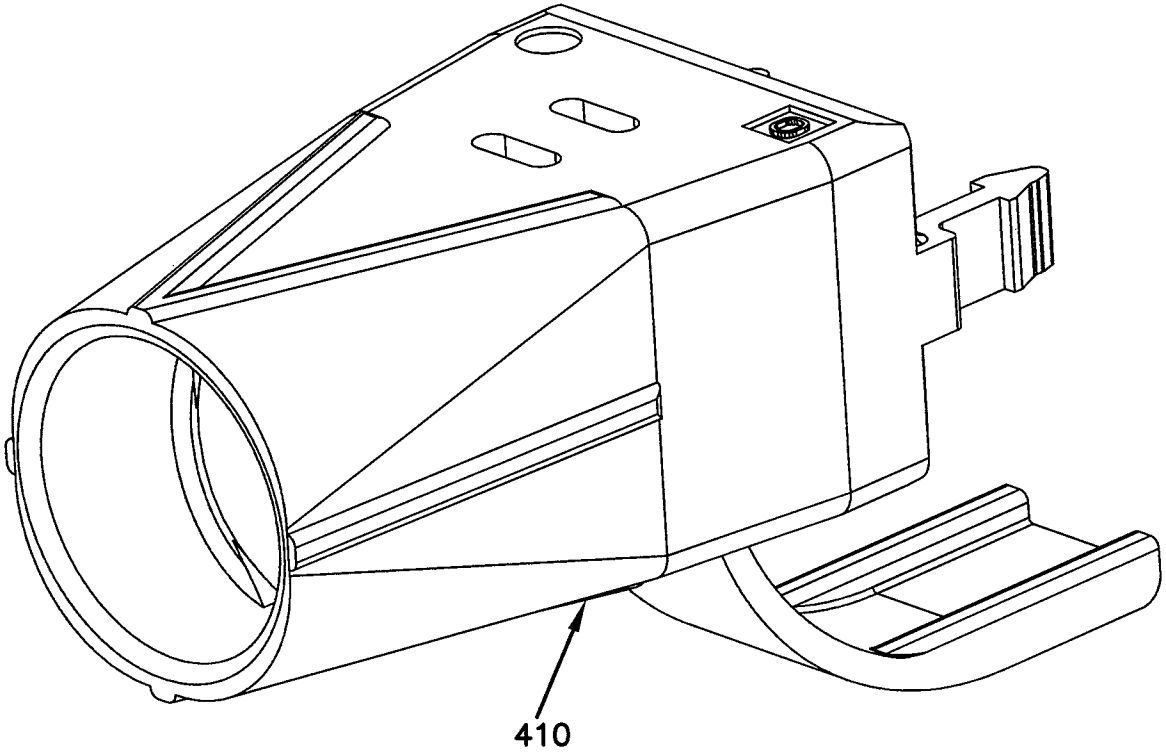

FIGS. 31 and 32 are cross-sectional views of the plug 402 and jack module 510. FIG. 31 shows the plug 402 prior to insertion into the socket 515 of the jack module 510. FIG. 32 shows the plug 402 inserted within the jack module 510 and pressing against the contacts 520, 530. As shown, the main signal contacts 412 on the plug 402 are configured to interface with the first set of contacts 520 when the plug 402 is inserted into the socket 515 of the jack module 510. The contacts 434 on the printed circuit board 420 within the plug 402 are configured to interface with the second set of contacts 530, which form a media reading interface, when the plug 402 is inserted into the socket 515 of the jack module 510.

The jack module 510 also includes a first section 512 configured to support a first printed circuit board 540, which connects the first set of contacts 520 with insulation displacement contacts (IDCs) 552 for signal transmission therebetween (see FIG. 31). Accordingly, inserting the plug 402 into the socket 515 connects the conductors of the electrical cable with other conductors terminated at the IDCs 552 (see FIG. 32). More specifically, inserting the plug 402 into the socket 515 brings the main signal contacts 412 of the plug 402 into contact with the first set of contacts 520 of the jack module 510, thereby establishing an electrical connection therebetween.

The jack module 510 also includes or is coupled to a second section 514 that is configured to support a second printed circuit board 560 (FIG. 32), which connects the second set of contacts 530 with a processor of a layer management system, such as programmable processor 206 of FIG. 2. For example, the second printed circuit board 560 can be inserted into a slot 516 defined by the second section 514 (FIG. 31). Accordingly, inserting the plug 402 into the socket 515 connects the storage device 430 on the plug 402 to the processor of the management system.

More specifically, inserting the plug 402 into the socket 515 brings the contacts 434 on the plug storage device 430 into contact with the second set of contacts 530 of the jack module 510, thereby establishing an electrical connection therebetween (see FIG. 32). Example connector assemblies 500 define openings 518 through which a connection is made between the plug storage contacts 434 and the second set of jack module contacts 530 (see FIG. 33). For example, the second set of contacts 530 can extend through the opening 518 to engage the plug storage contacts 434.

Referring to FIGS. 33-36 in accordance with certain aspects of the disclosure, electrical performance testing (e.g., channel testing) can be performed on the plug 402 and/or the cable 480 terminated thereby. Some types of performance testing are conducted by inserting the plug 402 terminating the cable 480 into the jack module 510 and monitoring the signals passed over the main signal contacts 412. In some implementations, the performance testing is conducted before the storage device 430 is inserted into the plug 402. If the plug 402 and cable 480 pass the performance testing, then the storage device 430 is positioned in the plug cavity 460 and the cover 406 is moved to the closed position. In one implementation, the cover 406 is latched in the closed position.

In certain implementations, the cover section 406 of the plug 402 remains in the open position while the plug 402 is inserted into the jack module 510. For example, in some implementations, the opening 518 defined in the jack module 510 is sufficiently sized and shaped to accommodate the cover section 406 when the cover section 406 is in the open position (see FIGS. 34-36).

For example, in certain implementations, a channel testing process includes terminating at least a first conductor at a first contact member 412 of a plug 402; inserting the plug 402 into a socket 515 of a connector assembly 500 while the cover 406 is in an initial position to bring the first contact member 412 into contact with a first contact member 520 of the connector assembly 500; and running a test signal to at least one of the first and second conductors to determine whether the first contact member 412 of the plug 402 is operational. The channel testing process may further include removing the plug 402 from the socket 515; installing memory in the cavity 460 of the plug 402; and moving the cover 406 to a subsequent position to enclose the memory within the cavity 460.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

The invention claimed is:

1. A connector arrangement comprising:

a plug nose body having a first side and an opposite, second side, the first side of the plug nose body being configured to hold a first set of contacts, which are electrically connected to conductors of an electrical segment of telecommunications media, the second side of the plug nose body defining a cavity;

a pivotal cover coupled to the plug nose body at the cavity, the pivotal cover being configured to move from an open position to a closed position, the pivotal cover allowing access to the cavity when in the open position and covering the cavity when in the closed position; and a storage device positioned within the cavity of the plug nose body, the storage device including memory configured to store information pertaining to the electrical segment of telecommunications media, the storage device being electrically connected to a second set of contacts, which are electrically isolated from the first set of contacts, the second set of contacts being configured to enable the stored information to be read from the storage device by a media reading interface.

2. The connector arrangement of claim 1, wherein the pivotal cover is connected to the plug nose body by a living hinge.

3. The connector arrangement of claim 1, wherein the pivotal cover is slotted to provide access to the second set of contacts through a body of the pivotal cover when the pivotal cover is in the closed position.

4. The connector arrangement of claim 1, wherein the first set of contacts are positioned at a front end of the plug nose body.

5. The connector arrangement of claim 1, wherein the plug nose body includes a finger tab protruding from the second side of the plug nose body, the finger tab including a latch surface for latching to a connector assembly.

6. The connector arrangement of claim 1, wherein the storage device includes a printed circuit board having a first side and a second side, the first side including the second set of contacts and the second side including the memory, the second set of contacts being electrically coupled to the memory.

7. The connector arrangement of claim 6, wherein the memory is an EEPROM chip.

8. A connector arrangement comprising:

a single-piece plug nose body defining a first set of slots and a second set of slots, the second set of slots being spaced apart from the first set of slots, the plug nose body defining a cavity beneath the second set of slot, the set second of slots including a living hinge extending across the slots to define a cover for the cavity in the plug nose body, the cover being moveable from an open position to a closed position;

a plurality of first contacts retained within the plug nose body beneath the first set of slots;

a plurality of second contacts retained within the cavity of the plug nose body beneath the second set of slots, the second contacts being electrically isolated from the first contacts.

9. The connector arrangement of claim 8, wherein the cover includes latching arms extending outwardly therefrom.

10. The connector arrangement of claim 9, wherein support members are located within the cavity, the latching arms of the cover being configured to engage the support members when the cover is moved to a closed position.

11. The connector arrangement of claim 8, wherein the cover is configured to pivot at least 90° relative to the plug nose body to cover the cavity defined in the plug nose body.

12. The connector arrangement of claim 8, wherein the second contacts are mounted to a printed circuit board.

13. The connector arrangement of claim 12, wherein the plug nose body includes guide members within the cavity along which the printed circuit board is slid to position the second contacts within the cavity.

* * * * *